US007775831B2

(12) United States Patent
Mase et al.

(10) Patent No.: US 7,775,831 B2
(45) **Date of Patent: *Aug. 17, 2010**

(54) CONNECTOR

(75) Inventors: Tsuyoshi Mase, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/359,573

(22) Filed: Jan. 26, 2009

(65) Prior Publication Data

US 2009/0191767 A1 Jul. 30, 2009

(30) Foreign Application Priority Data

Jan. 29, 2008 (JP) ..... 2008-017599

(51) Int. Cl.
*H01R 13/40* (2006.01)

(52) U.S. Cl. ..... 439/595

(58) Field of Classification Search ..... 439/595, 439/752

See application file for complete search history.

(56) References Cited

U.S. PATENT DOCUMENTS 7,488,221 B2 * 2/2009 Tanaka et al. ..... 439/752
2003/0087562 A1 * 5/2003 Okamoto et al. ..... 439/752
2005/0233652 A1 * 10/2005 Tsuji ..... 439/886
2007/0218780 A1 * 9/2007 Onoda et al. ..... 439/752

FOREIGN PATENT DOCUMENTS

JP 2003-059590 2/2003

* cited by examiner

*Primary Examiner*—Phuong K Dinh
(74) *Attorney, Agent, or Firm*—Gerald E. Hespos; Michael J. Porco

(57) ABSTRACT

An accommodation recess (17) is formed in the front surface of a housing main body (11). A plate-like lance housing (70) including locking lances (19) for primarily locking terminal fittings (130) by resiliently deformably projecting at inner surfaces of terminal accommodation holes (71) is accommodated into the accommodation recess (17). A plate-like retainer (50) movable to a partly locked position for permitting the insertion of the terminal fittings (130) into the terminal accommodation holes (71) and to a fully locked position for secondarily locking the terminal fittings (130) is also accommodated into the accommodation recess (17). The rear surface of the lance housing (70) and the front surface of the retainer (50) are arranged in contact with each other.

8 Claims, 22 Drawing Sheets

CONNECTOR

BACKGROUND OF THE INVENTION

1. Field of the Invention

The invention relates to a connector and to an assembling or mounting method therefor.

2. Description of the Related Art

Japanese Unexamined Patent Publication No. 2003-59590 discloses a connector provided with a retainer. This connector is provided with a housing including cavities, into which terminal fittings are insertable, and a retainer to be mounted through a side surface of the housing while crossing the cavities. Resiliently deformable locking lances project in the cavities of the housing before a retainer mounting portion, and the terminal fittings properly inserted into the cavities are primarily locked by these locking lances. Further, the retainer is movable to a partly locked position and to a fully locked position. At the partly locked position, retaining portions of the retainer are retracted from the cavities to permit the insertion of the terminal fittings into the cavities. At the fully locked position, the retaining portions enter the cavities to secondarily lock the terminal fittings.

With a multipolar connector provided with a double locking mechanism for terminal fittings as described above, resin flowability to the respective parts decreases upon molding a housing and it is particularly difficult to form parts around cavities and small-size locking lances. Thus, there are cases where it is requested to mold a connector housing while separating it into a housing main body including no locking lances and a lance housing including locking lances and these two are integrally assembled after the molding. However, in such a case, the lance housing is arranged on the front surface of the housing main body while the housing main body is provided with a retainer mounting portion. Thus, there is a problem of making the length in forward and backward directions longer to enlarge the connector.

The invention was developed in view of the above situation and an object thereof is to avoid the enlargement of a connector provided with a housing main body, a retainer and a lance housing.

SUMMARY OF THE INVENTION

The invention relates to a connector having a housing main body with one or more cavities for receiving one or more respective terminal fittings. A lance housing is located at a front side of the housing main body and includes one or more terminal accommodation holes that communicate with the respective cavities. One or more resiliently deformable locking lances project at the terminal accommodation holes to achieve primary locking of the terminal fittings accommodated in the terminal accommodation holes. A retainer is located behind the lance housing and is movable between first and second positions. The retainer permits insertion of the terminal fittings into the terminal accommodation holes when the retainer is at the first position. However, the retainer achieves secondary locking of the terminal fittings when the retainer is at the second position. The rear surface of the lance housing and the front surface of the retainer contact each other. Thus, no front part of the housing main body is between the lance housing and the retainer and the length of the connector in forward and backward directions is shortened by that much.

The retainer preferably is mountable through a side surface of the housing main body.

The housing main body preferably includes retainer positioning means for positioning the retainer. Accordingly, retainer is positioned in the lance housing and also in the housing main body by the retainer positioning means. Thus, the assembled retainer is held in a proper position in the housing main body even if the lance housing is displaced from a proper assembled position with respect to the housing main body. As a result, the retainer can reliably face locking positions for the terminal fittings at the fully locked position, and the reliability of a locking function of the retainer can be ensured.

The housing main body preferably includes lance housing positioning means for positioning the lance housing. Accordingly, the lance housing is not displaced following a movement of the retainer, and the stability of the movement of the retainer is ensured even if the lance housing and the retainer come into contact.

At least one guiding groove preferably is formed in one of the rear surface of the lance housing and the front surface of the retainer and extends in a moving direction of the retainer. At least one guiding rib is provided on the other and is engageable with the respective guiding groove. The guiding rib slides along the guiding groove during the movement of the retainer, so that the retainer can move smoothly. Engagement of the guiding rib and guiding groove prevent displacements of the retainer and the lance housing.

The housing main body preferably is formed with an accommodation recess capable of at least partly accommodating the retainer.

The guiding groove preferably is formed in one of the back surface of the accommodation recess and the rear surface of the retainer, whereas guiding rib is provided on the other.

A front holder preferably is arranged on the front surface of the lance housing for at least partly covering the locking lances.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

DETAILED DESCRIPTION OF THE PREFERRED EMBODIMENTS

Figure 1:
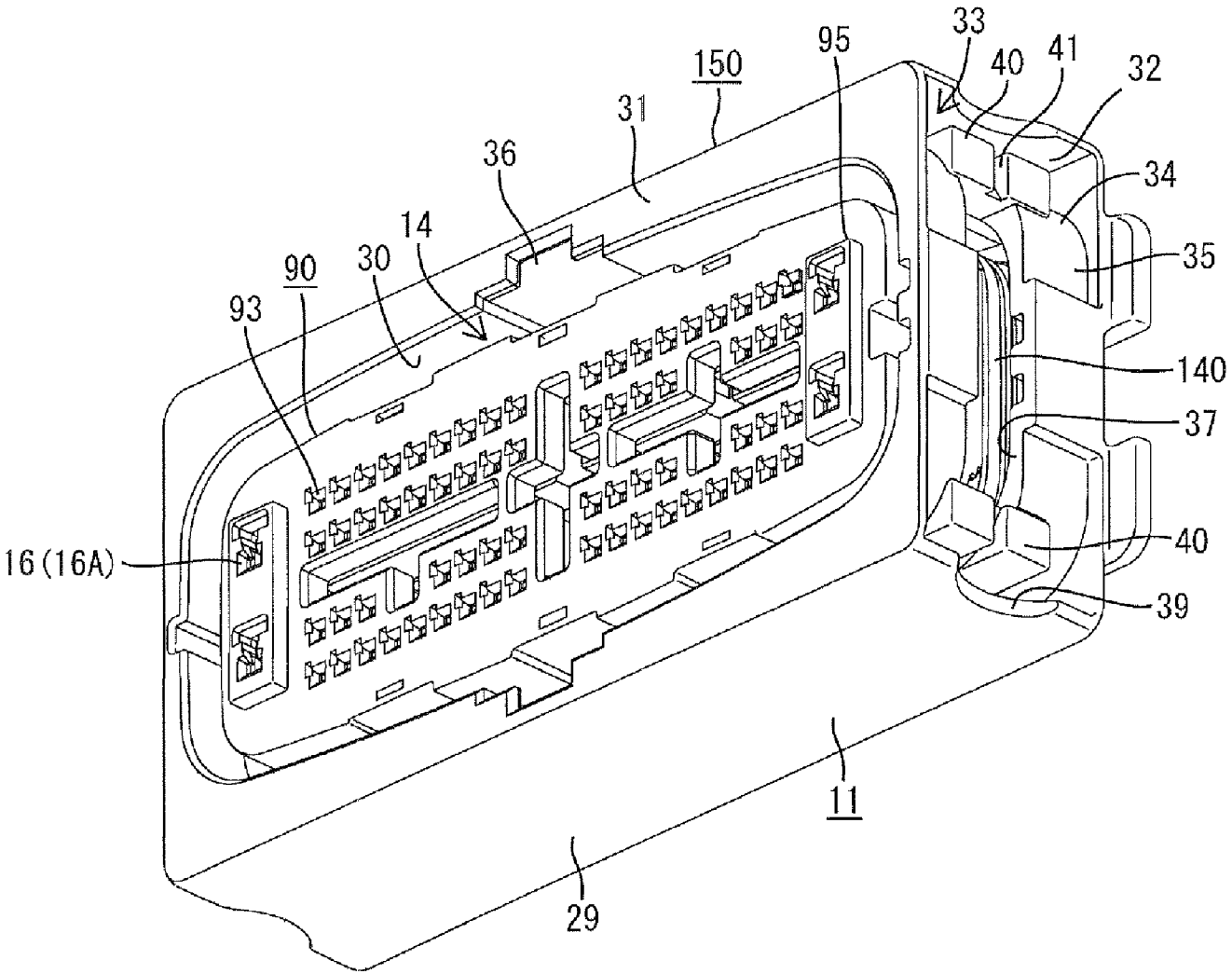
FIG. 1 is a perspective view of a connector housing according to a first embodiment of the invention.

A connector in accordance with a first embodiment of the invention is illustrated in FIGS. 1 to 18 and is identified generally by the numeral 10. The connector 10 of this embodiment is provided with a housing main body 11 (main body), a retainer 50, a lance housing 70, a front holder 90, a (preferably slide type) lever 110, one or more terminal fittings 130 and/or a seal ring 140. The housing main body 11, the retainer 50, the lance housing 70, the front holder 90 and the lever 110 are made e.g. of a synthetic resin, the terminal fittings 130 are made of an electrically conductive material such as metal and the seal ring 140 is made of a resilient material such as rubber. The housing main body 11, the lance housing 70 and the front holder 90 form part of a connector housing 150. In the following a side of the connector to be mated with a mating connector is referred to as front or front side.

Figure 10:
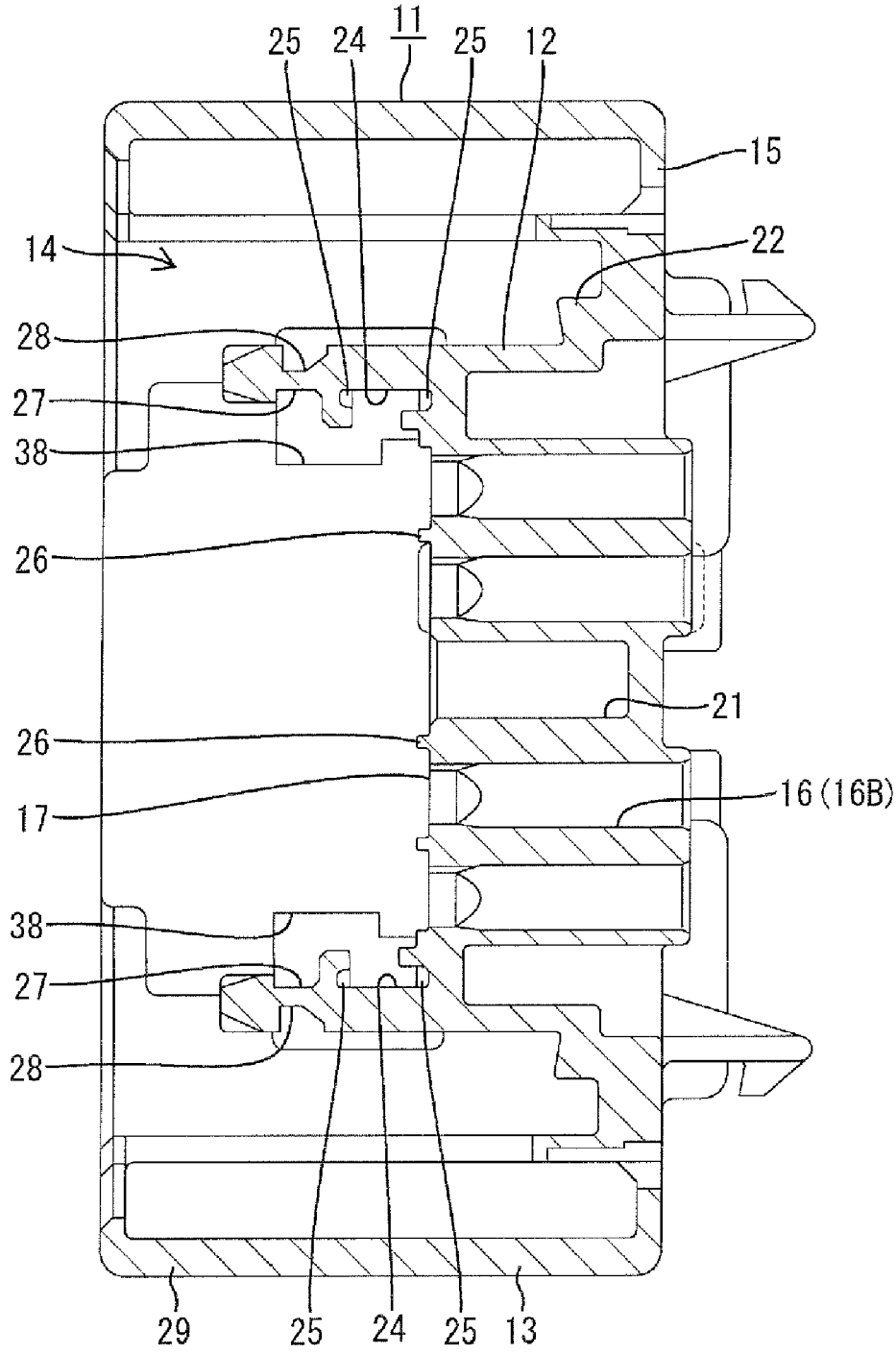
FIG. 10 is a vertical section of the housing main body.
Figure 11:
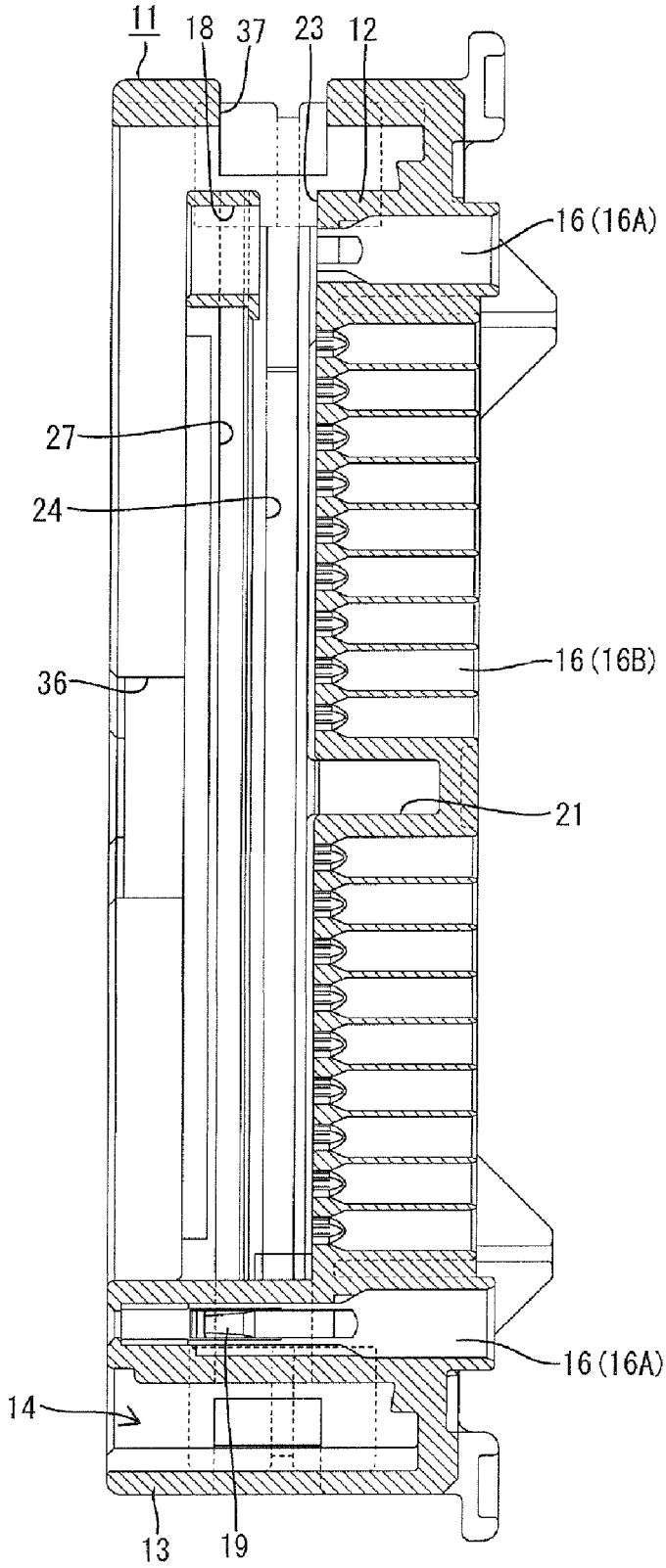
FIG. 11 is a horizontal section of the housing main body.
Figure 12:
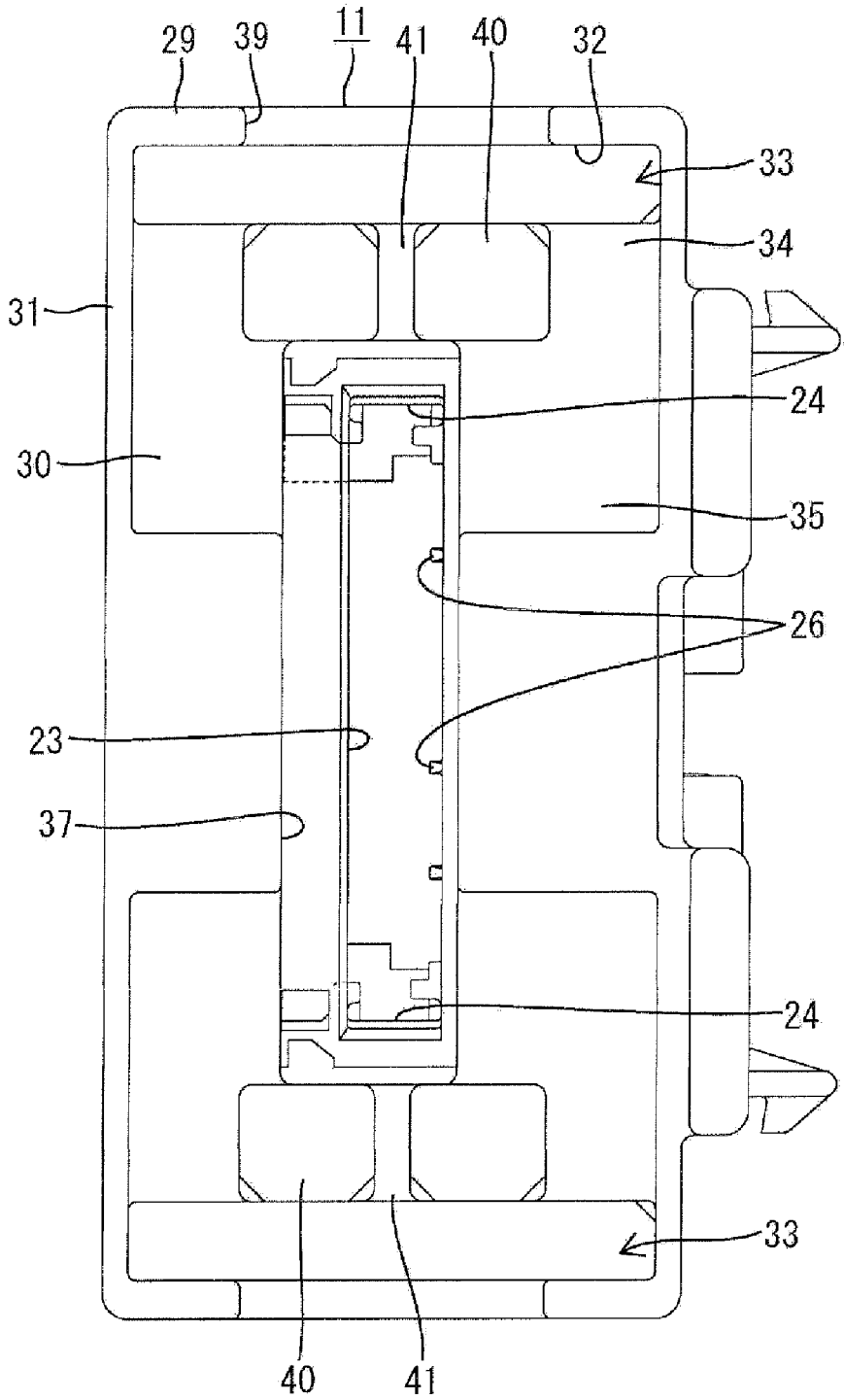
FIG. 12 is a side view of the housing main body.

The housing main body 11 includes a wide rectangular terminal inserting portion 12 a fitting tube 13 that surrounds the terminal inserting portion 12. A connection space is defined between the terminal inserting portion 12 and the fitting tube portion 13 as shown in FIGS. 10 to 12 for receiving a receptacle 220 of a mating housing 210 of a mating male connector 200. A coupling 15 extends between the rear end of the outer surface of the terminal inserting portion 12 and the rear end of the inner surface of the fitting tube 13.

The terminal inserting portion 12 has cavities 16 for receiving terminal fittings 130 from behind. The cavities 16 include large cavities 16A for receiving large terminal fittings 130 and small cavities 16B for receiving small terminal fittings 130. The large cavities 16A are provided at each of the opposite widthwise end parts of the terminal inserting portion 12, and the small cavities 16B are in a widthwise intermediate part of the terminal inserting portion 12.

A wide rectangular accommodation recess 17 is formed in a widthwise intermediate part of the front surface of the terminal insertion portion 12, which is the end of the terminal insertion portion 12 to be mated with the mating connector and opposite to the end where the terminal fittings 130 are inserted. The accommodation recess 17 can accommodate the lance housing 70 and the retainer 50. The front ends of the small cavities 16B are in the back surface of the accommodation recess 17, and the large cavities 16A are near the opposite widthwise sides of the accommodation recess 17. Thus, the front ends of the small cavities 16B are more backward than front ends of the large cavities 16A. Further, upper and lower tower mounting windows 18 are provided in the inner walls of the large cavities 16A at the opposite left and right sides before the front ends of the small cavities 16B. The tower mounting windows 18 can receive cavity towers 95 of the front holder 90. Resiliently deformable upper and lower locking lances 19 are provided in the inner walls of the large cavities 16A and project more forward than the front ends of the small cavities 16B. The locking lance 19 lock terminal fittings 130 inserted into the cavities 16 while connected with ends of wires 160. Seal plugs 170 are mounted on the ends of the wires 160 to provide close sealing contact between the seal plugs 170 and the inner walls of the cavities 16.

A substantially horizontal slit 20 is formed above the tower mounting windows 18 in the front surface of the terminal insertion portion 12 and communicates with a corner of the accommodation recess 17. Cross-shaped or T-shaped connection rib insertion holes 21 are formed substantially side by side in a width direction in dead spaces between arrays of the small cavities 16B in the back surface of the accommodation recess 17 of the terminal insertion portion 12. The connection rib insertion holes 21 are bottomed and can receive connection ribs 240 from the front.

A step 22 is provided on the outer surface of the terminal insertion portion 12 at the front surface of the coupling 15. An annular seal ring 140 is mounted before the step 22 on the outer surface of the terminal insertion portion 12. The seal ring 140 contacts the opening edge at the front end of the receptacle 220 when the two housings 150, 210 are connected properly to provide sealing between the two housings 150, 210.

A vertically long retainer insertion hole 23 is formed in one side surface of the terminal insertion portion 12. The retainer insertion hole 23 crosses the tower mounting windows 18 of the large cavities 16A and communicates with the back side of the accommodation recess 17. Rail grooves 24 extend in the width direction on the opposite upper and lower inner surfaces of the accommodation recess 17 at positions substantially continuous with the retainer insertion hole 23. Connecting protrusions 58 of the retainer 50 engage the rail grooves 24 to retain the retainer 50. Front and rear retainer holding projections 25 are provided at back ends of the groove surfaces of each rail groove 24 with respect to an inserting direction of the retainer 50. The retainer 50 can engage the retainer holding projections 25 to be held at a partly locked position or at a fully locked position. First guiding ribs 26 extend substantially in the width direction on the back surface of the accommodation recess 17 of the terminal insertion portion 12. The first guiding ribs 26 are located between groups of the smaller cavities 16B divided in a plurality of vertical levels and are arranged one above another in a vertical direction.

Lance housing locking grooves 27 are formed in the opposite upper and lower inner surfaces of the accommodation recess 17 in the terminal insertion portion 12 for retaining the lance housing 70, and front holder locking grooves 28 are formed in the opposite upper and lower outer surfaces of the terminal insertion portion 12 for retaining the front holder 90. The lance housing locking grooves 27 and the front holder locking grooves 28 are arranged in a back-to-back relationship and extend long in the width direction.

As shown in FIG. 1, the fitting tube 13 is made up of outer plates 29, an inner plate 30 and front and rear closing plates 31 connecting opposite front and rear ends of the outer and inner plates 29 and 30. The outer plates 29 are at opposite upper and lower ends in parallel with each other. The inner plate 30 is a tube disposed inward of the outer plates 29 and surrounds the terminal insertion portion 12. The closing plates 31 have outer edges with a substantially wide rectangular front view. Opposite upper and lower walls of the fitting tube 13 have a double plate structure so that a mount recess 32 for the lever 110 is defined by the outer plates 29, the inner plate 30 and the closing plates 31. The mount recess for the lever 110 opens at the opposite ends of the fitting tube 13 through clearances between the outer and inner plates 29 and 30.

The mount recess 32 includes arm plate insertion spaces 33 that are partly enclosed by the outer surface of the inner plate 30, the inner surfaces of the outer plates 29 and the inner surfaces of the closing plates 31. The arm plate insertion spaces 33 can receive arm plates 112 of the lever 110 so that the arm plates 112 are surrounded at four sides.

The outer plates 29 are substantially horizontal and flat. Four corners of the outer edges of the closing plates 31 have outward angular shapes that conform to the outer plates 29. On the other hand, the inner plate 30 is shaped to draw arcs with a small curvature in widthwise intermediate parts of the opposite upper and lower ends and draw arcs with a small curvature at the opposite widthwise ends. Curved surfaces 34 extend along specified arcs at corner portions of the opposite widthwise ends. The outer side surfaces of the inner plate 30, (inner surfaces of the mount recess 32), including these curved surfaces 34 define mounting surfaces 35 that face and contact the operable plate 111 of the lever 110.

Upper and lower follower pin introducing grooves 36 open forwardly at widthwise intermediate positions of the upper and lower parts of the inner plate 30 at positions continuous with the closing plates 31. The follower pin introducing grooves 36 are configured to receive mating follower pins 250. A vertically long retainer introducing hole 37 penetrates at least one of the opposite side walls of the inner plate 30 and communicates with the retainer insertion hole 23 via the connection space 14 for permitting insertion of the retainer 50. Upper and lower mold removal holes 38 are formed at least in the other of the opposite side walls of the inner plate 30 upon forming the retainer holding projections 25 and are symmetrical with respect to the retainer introducing hole 37. Finger escaping portions 39 are formed at the opposite widthwise end edges of the outer plates 29 for receiving fingers of an operator moving the lever 110.

Four forced connection preventing portions 40 project on the curved surfaces 34 of the mount recess 32 in the tubular fitting 13 for interfering with the connection ribs 240 that project on the back surface of the receptacle 220 and for stopping the connecting operation if the housing 150 is in an improper inclined posture at the time of connection with the mating connector 200. The forced connection preventing portions 40 are blocks that project angularly at the four corners corresponding to the curved surfaces 34 of the mount recess 32 while covering intermediate parts of the curved surfaces 34 in forward and backward directions. The outer edges of the forced connection preventing portions 40 substantially conform to the shapes of the four corners of the closing plates 31, the outer surfaces thereof define horizontal sliding surfaces for the arm plates 112 and the inner ends thereof define the outer edges of the retainer introducing hole 37 and the mold removal holes 38.

A slit-shaped groove 41 is formed in the center of each forced connection preventing portion 40 in forward and backward directions and has a depth to reach the curved surface 34. The grooves 41 receive corresponding ribs 123 of the lever 110. The width of the grooves 41 is smaller than the thickness of the connection ribs 240 so that the connection ribs 240 do not accidentally enter the grooves 41 in the case of a forced connection attempt.

Figure 17:
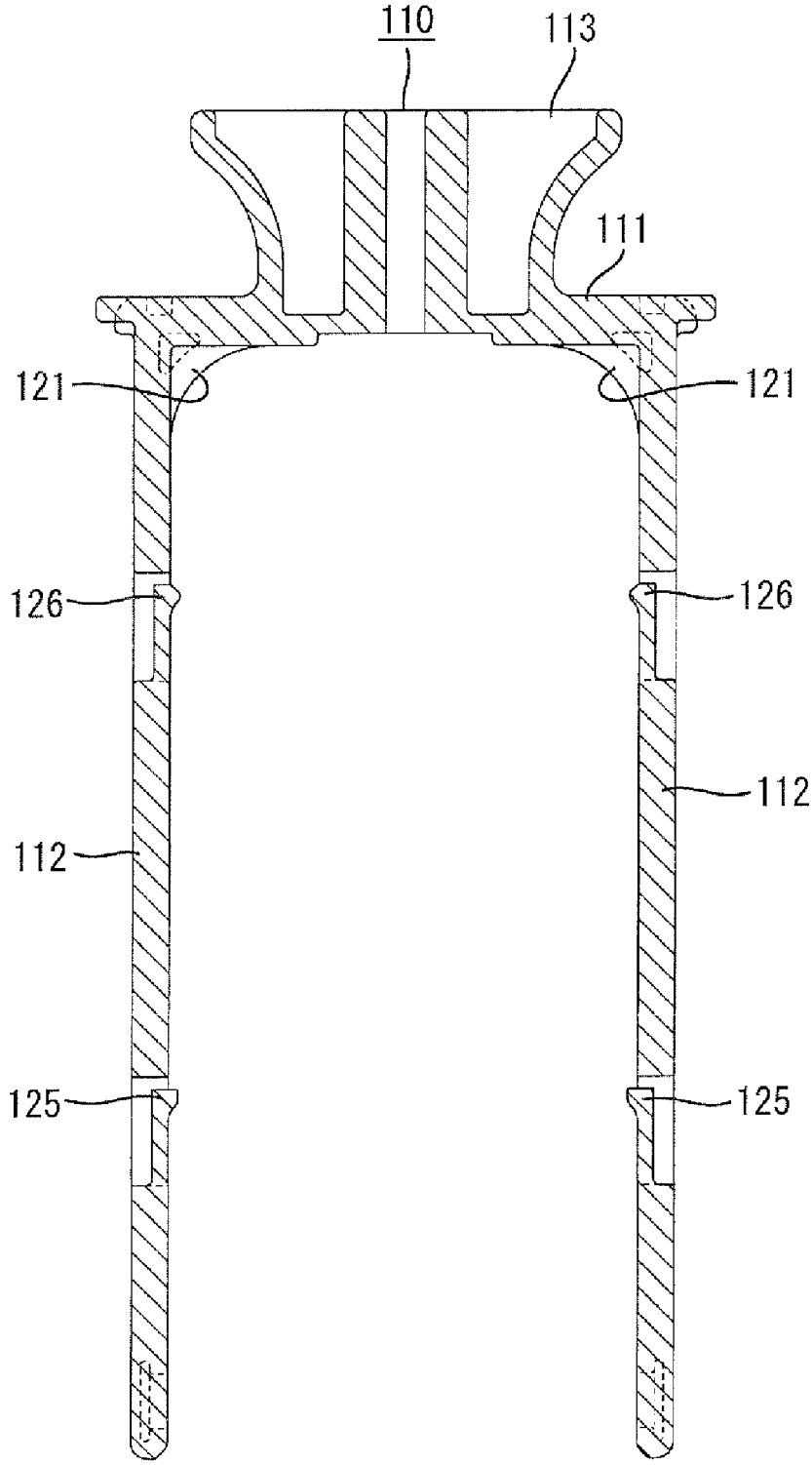
FIG. 17 is a vertical section of a lever.

As shown in FIG. 17, the lever 110 includes the operable plate 111 and upper and lower arm plates 112 that project from opposite ends of the operable plate 111 to define a substantially U-shaped. The lever 110 can be assembled from the opposite widthwise ends of the mount recess 32 and an assembling direction can be switched between two opposite directions e.g. according to a situation at an assembling site, such as the avoidance of interference with a peripheral part. The lever 110 is slidable between a standby position and a connection position. A grip 113 projects out and can be gripped for operating the lever 110.

Figure 4:
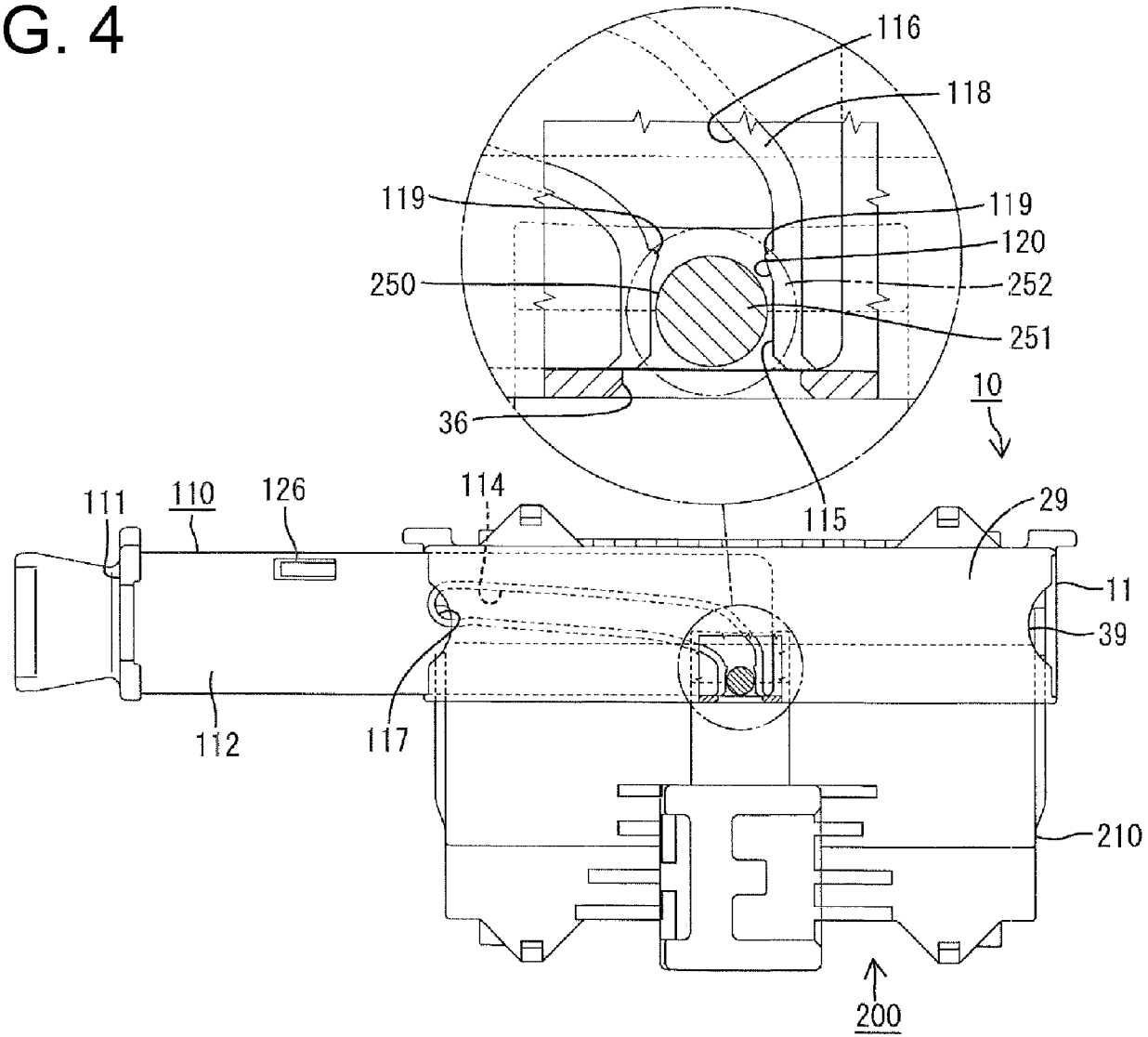
FIG. 4 is a plan view partly in section showing follower pins in introducing portions of cam grooves and two housings left partly connected.

A cam groove 114 penetrates each arm plate 112 in a thickness direction, as shown in FIG. 4, and is engageable with the mating follower pin 250. An introducing portion 115 extends in substantially forward and backward directions at the entrance of the cam groove 114 for receiving the follower pin 250. An acting portion 116 extends obliquely back from the back end of the introducing portion 115 and cooperates with the follower pin 250 for exhibiting a cam action. A play portion 117 is provided at the back end of the acting portion 116 and is aligned so that the connecting operation does not proceed further by sliding the lever 110 after completion of the connecting operation. Groove edge portions 118 project inwardly on the inner surfaces of each cam groove 114 substantially in parallel with a plate surface direction and define steps. Flanges 252 bulge out from the leading ends of the follower pins 250 over substantially the entire circumference and slide on the groove edge portions 118. Thus, the follower pins 250 and the cam grooves 114 are kept engaged and the arm plates 112 will not move away from each other due to connection resistance.

Front portions of the arm plates 112 of the lever 110 are inserted lightly in the mount recess 32 when the lever 110 is at the standby position. In this state, the mating follower pins 250 enter the introducing portions 115 of the cam grooves 114 so that the two housings 150, 210 are partly connected. The arm plates 112 of the lever 110 can be inserted deeply into the mount recess 32 so that the lever 110 reaches the connection position and so that the two housings 150, 210 become fully connected. This connection requires only a small operation force due to the cam actions between the follower pins 250 and the acting portions 116 of the cam grooves 114 as the lever 110 moves. The diameters of shafts 251 of the follower pins 250 are less than the widths of the introducing portions 115 and the acting portions 116 of the cam grooves 114.

Left and right protuberances 119 are provided laterally symmetrically on the groove surfaces at the opposite widthwise sides of each introducing portion 115 and substantially equidistant from the front entrance end of the cam groove 114. Each protuberance 119 has a guiding slant 120 inclined with respect to a moving direction of the follower pin 250 and the leading end thereof is rounded. A distance between the two protuberances 119 is slightly shorter than the diameter of the shaft 251 of the corresponding follower pin 250. Thus, the protuberances 119 temporarily prevent the follower pins 250 from moving toward the acting portions 116 and hold the two housings 150, 210 in a partly locked state. Parts of the arm plate 112 at opposite sides of the introducing portion 115 are deformed resiliently away from each other when the follower pin 250 passes the protuberances 119.

Figure 2:
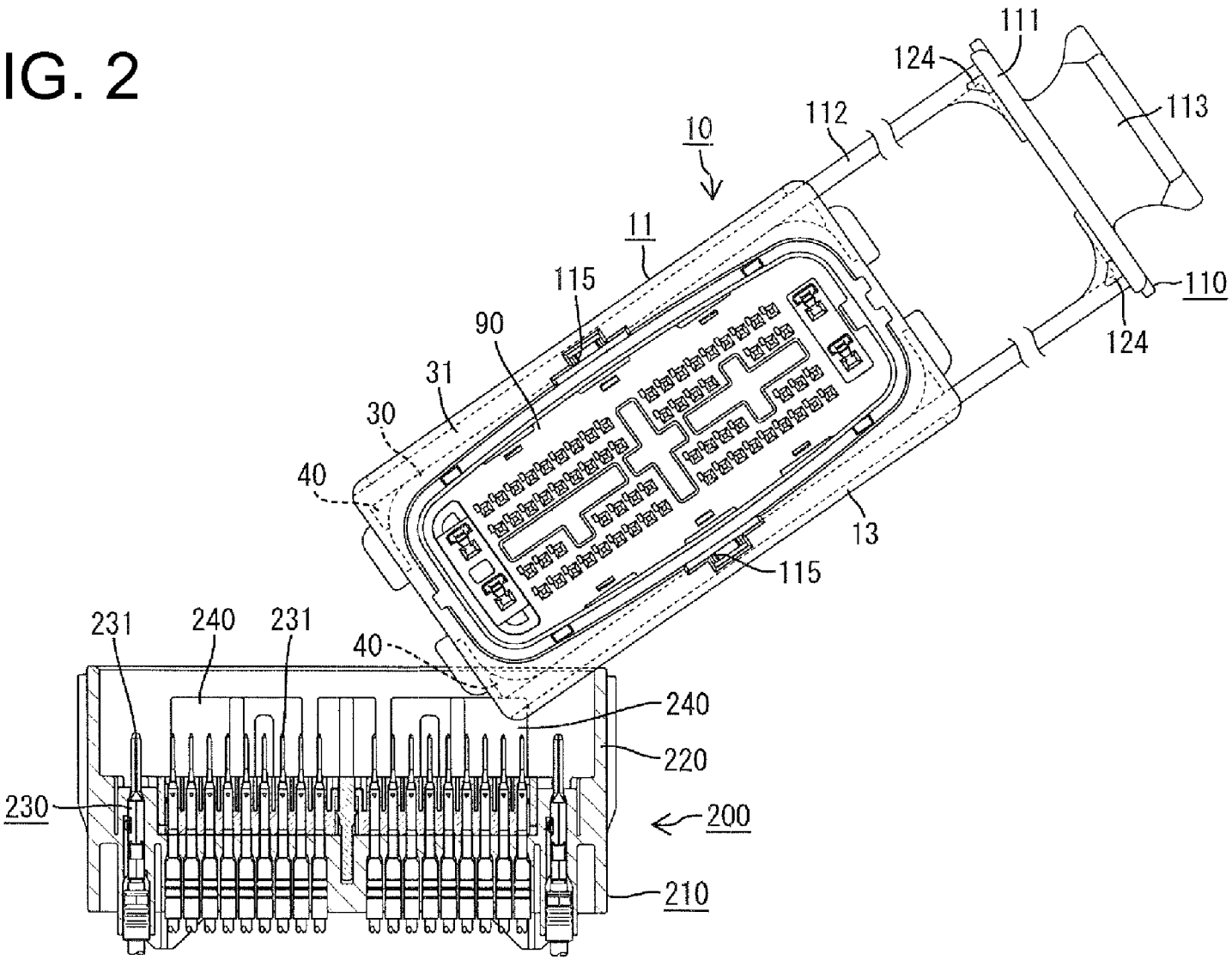
FIG. 2 is a front view showing a forced connection is prevented by a forced connection preventing portion when a housing is in an improper posture.
Figure 3:
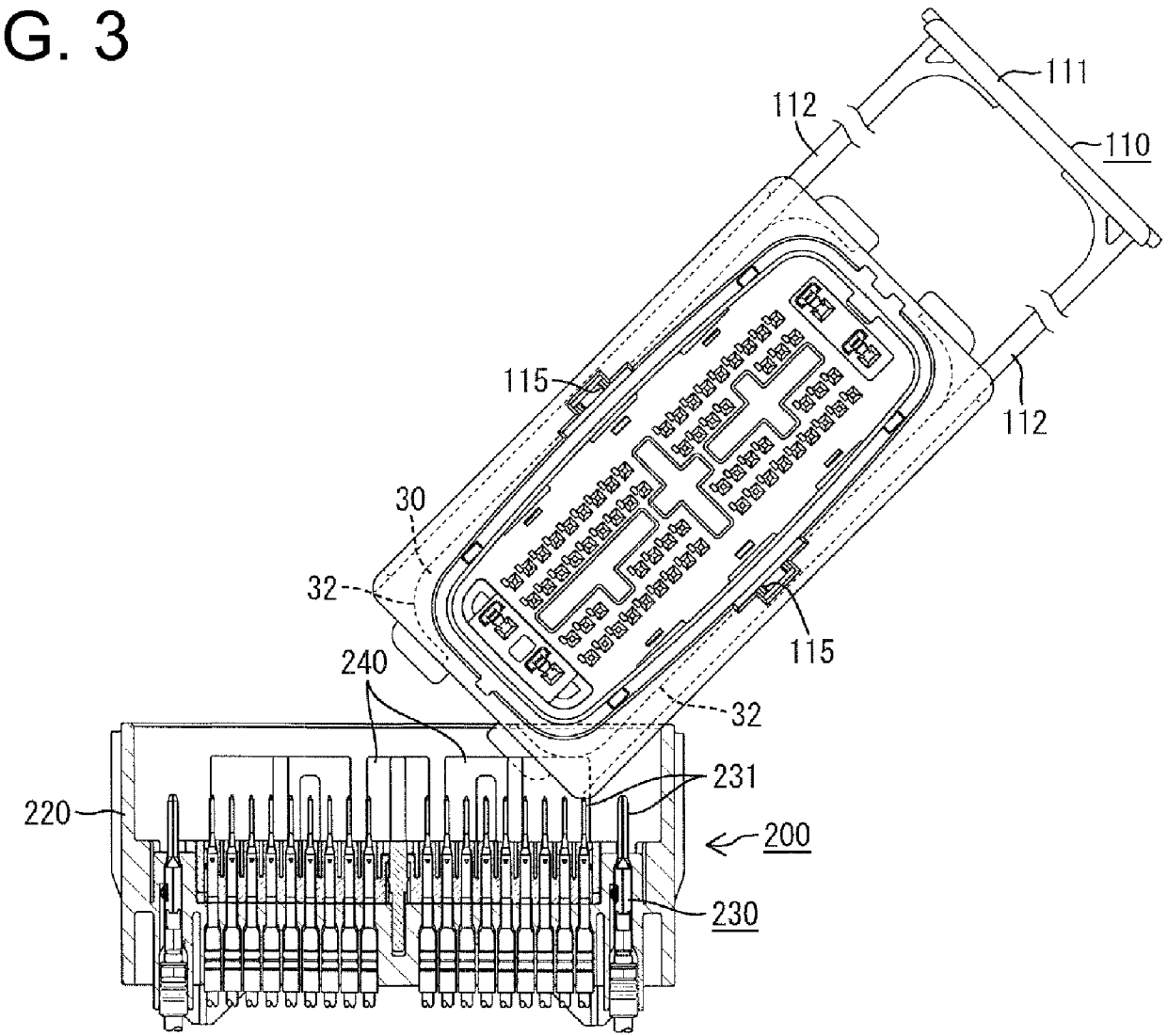
FIG. 3 is a reference diagram showing a state where forced connection occurs when the connector housing is in an improper posture.
Figure 18:
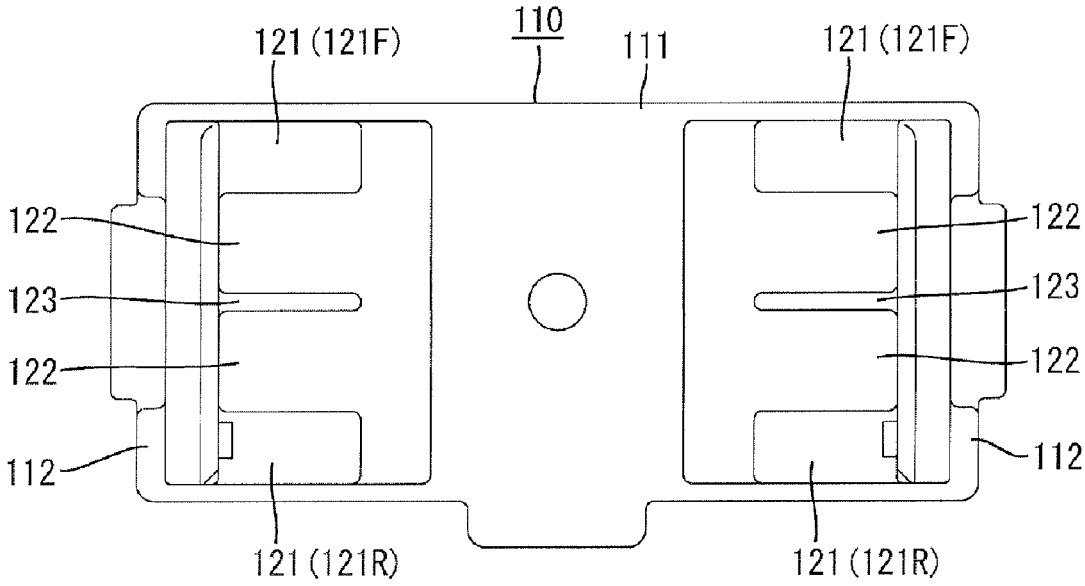
FIG. 18 is a side view of the lever.

As shown in FIG. 18, the inner surface of the operable plate 111 is raised at the opposite upper and lower corners continuous with the inner surfaces of the arm plates 112 to form reinforcements 121 with substantially quarter circular curved surfaces in front view that extend along the curved surfaces 34 of the mount recess 32. The reinforcements 121 prevent the arm plates 112 from moving away from each other when the lever 110 is left alone. Escaping portions 122, are formed in the inner surfaces of the reinforcements 121 and receive the respective forced connection preventing portions 40 of the mount recess 32 when the lever 110 is at the connection position. Intermediate ribs 123 are provided in the escaping portions 122 and define partition walls that divide the escaping portion 122 into front and rear sections substantially at the center of the operating plate 111 in forward and backward directions. Each reinforcement 121 is divided by the escaping portion 122 to define a front reinforcement 121F at a front side and a rear reinforcement 121R at a rear side. The front and rear reinforcements 121F, 121R have substantially the same thickness. Each intermediate rib 123 is located substantially in the middle between the front and rear reinforcing portions 121F, 121R, has a substantially quarter circular shape of the same size as the reinforcements in front view and a smaller thickness than the both reinforcements. The thickness of the intermediate ribs 123 is slightly smaller than the width of the grooves 41 of the forced connection preventing portions 40. As shown in FIG. 2, bores 124 are formed in the exposed front surfaces of the front reinforcements 121F and rear surfaces of the rear reinforcements 121R and have surfaces extending along the inner edges of the reinforcements 121. The bores 124 cause connected parts of the operable plate 111 and the arm plates 112 to be at substantially right angles to each other.

First lever locks 125 and second lever locks 126 are provided successively from the front end of the arm plates 112 at positions behind the cam grooves 114 and are spaced apart by a specified distance in the width direction. Sides of the lever locks 125, 126 toward the operable plate 111 are resiliently deformable in the thickness directions of the arm plates 112 with sides thereof toward the leading ends of the arm plates 122 as base ends. The lever locks 125, 126 are arranged at the inner sides of the arm plates 112 with respect to the thickness direction, and deformation areas for the lever locks 125, 126 are defined at the outer sides of the arm plates 112 with respect to the thickness direction. Lever interlocking portions (not shown) are provided at positions of the inner surfaces of the mount recess 32 corresponding to the lever locks 125, 126. The lever 110 is held at the standby position by resiliently engaging the first lever locks 125 with the lever interlocking portions at a shallow position of the mount recess 32, whereas the lever 110 is held at the connection position by resiliently engaging the second lever locks 126 with the lever interlocking portions at a deep position of the mount recess 32.

Figure 9:
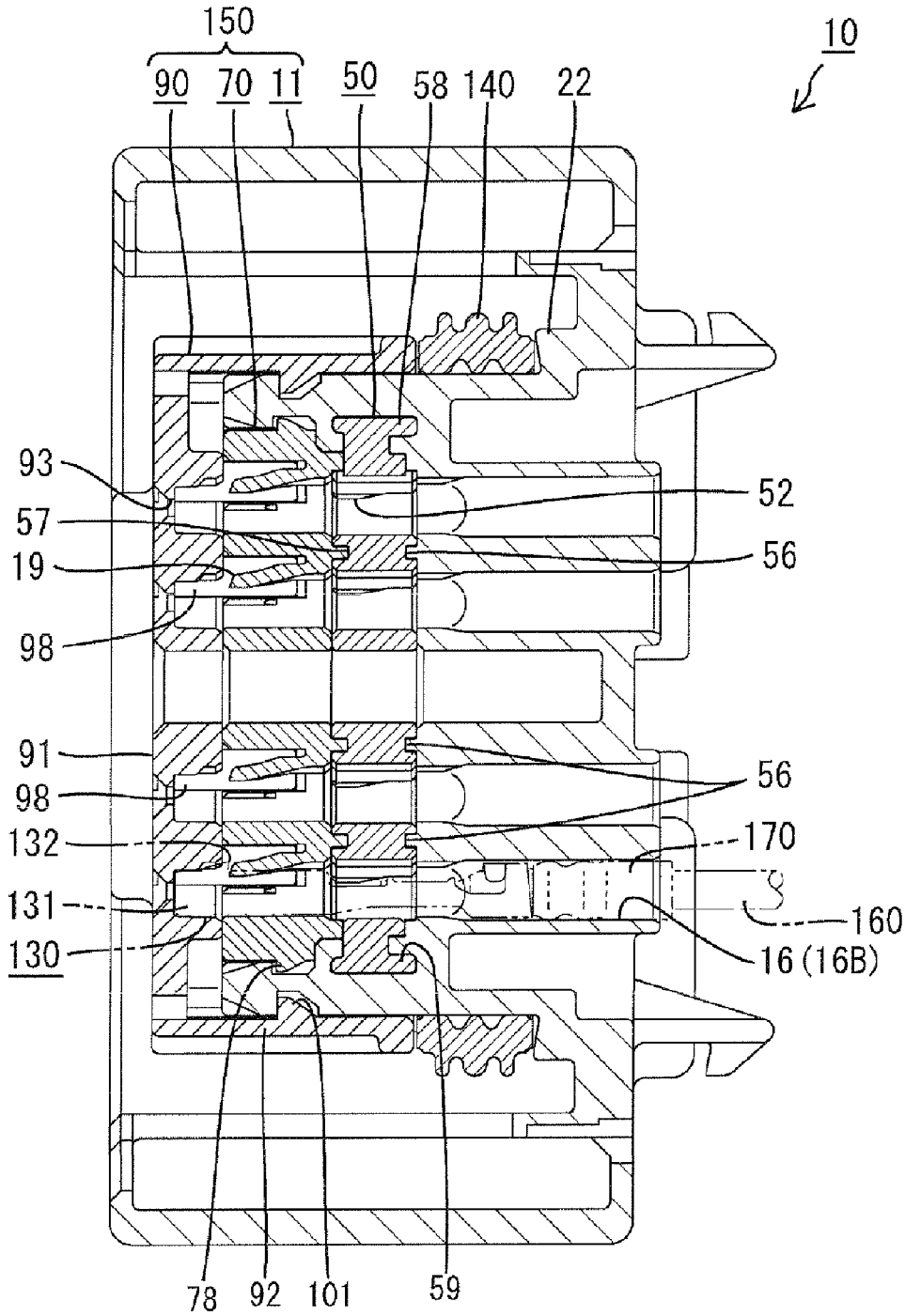
FIG. 9 is a section along B-B of FIG. 8.
Figure 13:
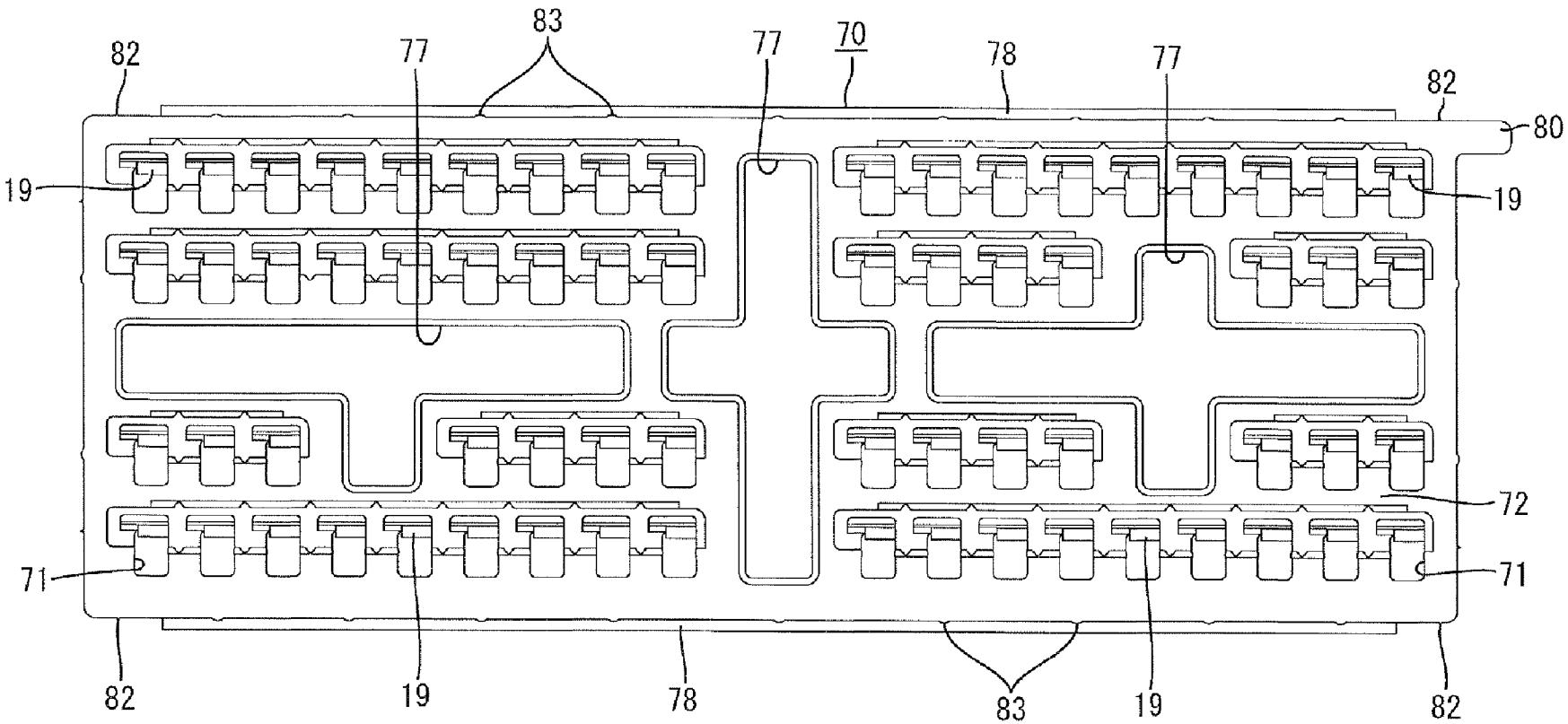
FIG. 13 is a front view of the lance housing.
Figure 14:
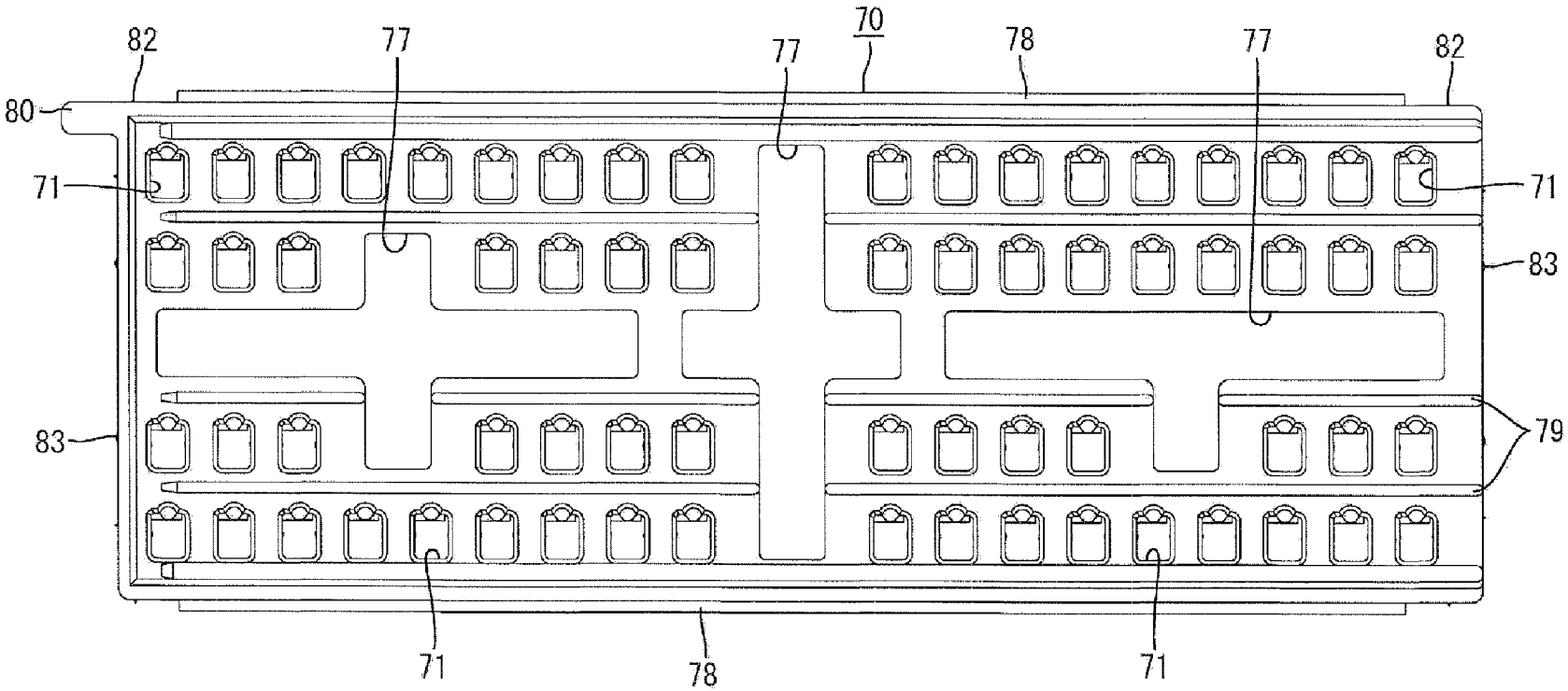
FIG. 14 is a rear view of the lance housing.
Figure 15:
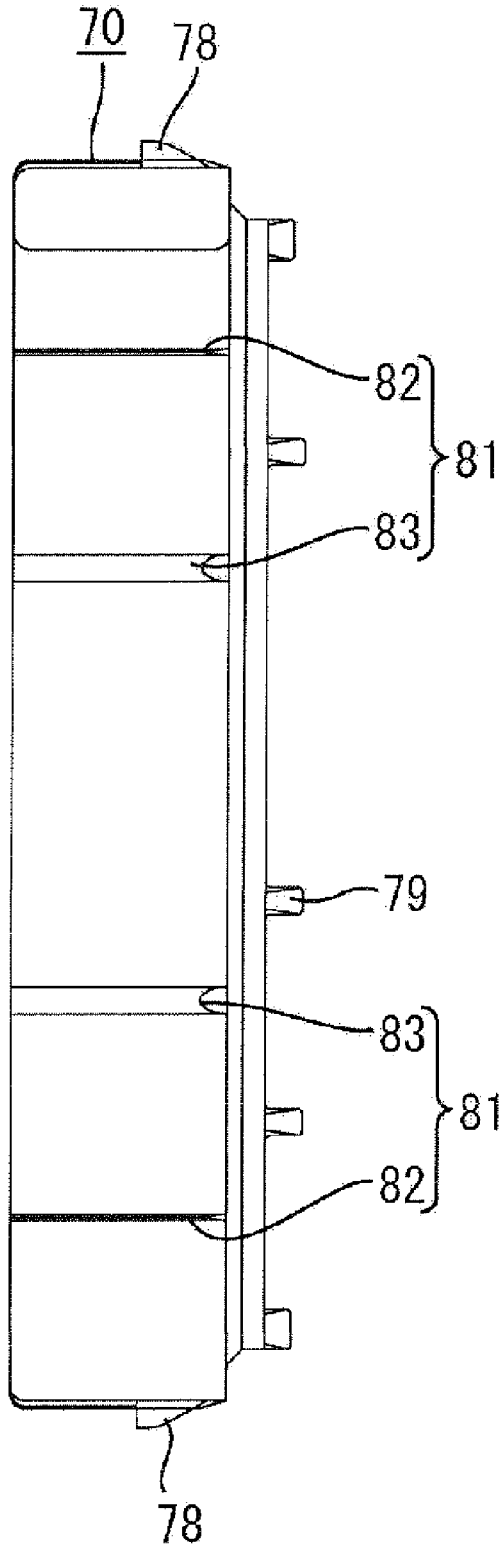
FIG. 15 is a side view of the lance housing.

The lance housing 70 is arranged on the front side of the housing main body 11 and is substantially a wide rectangular plate in front view with a shape corresponding to the shape of the accommodation recess 17 of the housing main body 11, as shown in FIGS. 13 to 15. The lance housing 70 has terminal accommodation holes 71 that communicate with the respective small cavities 16B via window holes 51 of the retainer 50 at positions corresponding to the small cavities 16B. A locking lance 19 cantilevers forward from an upper inner surface of each terminal accommodation hole 71. As shown in FIG. 9, the locking lance 19 achieves primary locking of the terminal fitting 130 accommodated in the terminal accommodation hole 71 by engaging an engageable portion 132 of a rectangular box 131 of the terminal fitting 130.

Figure 7:
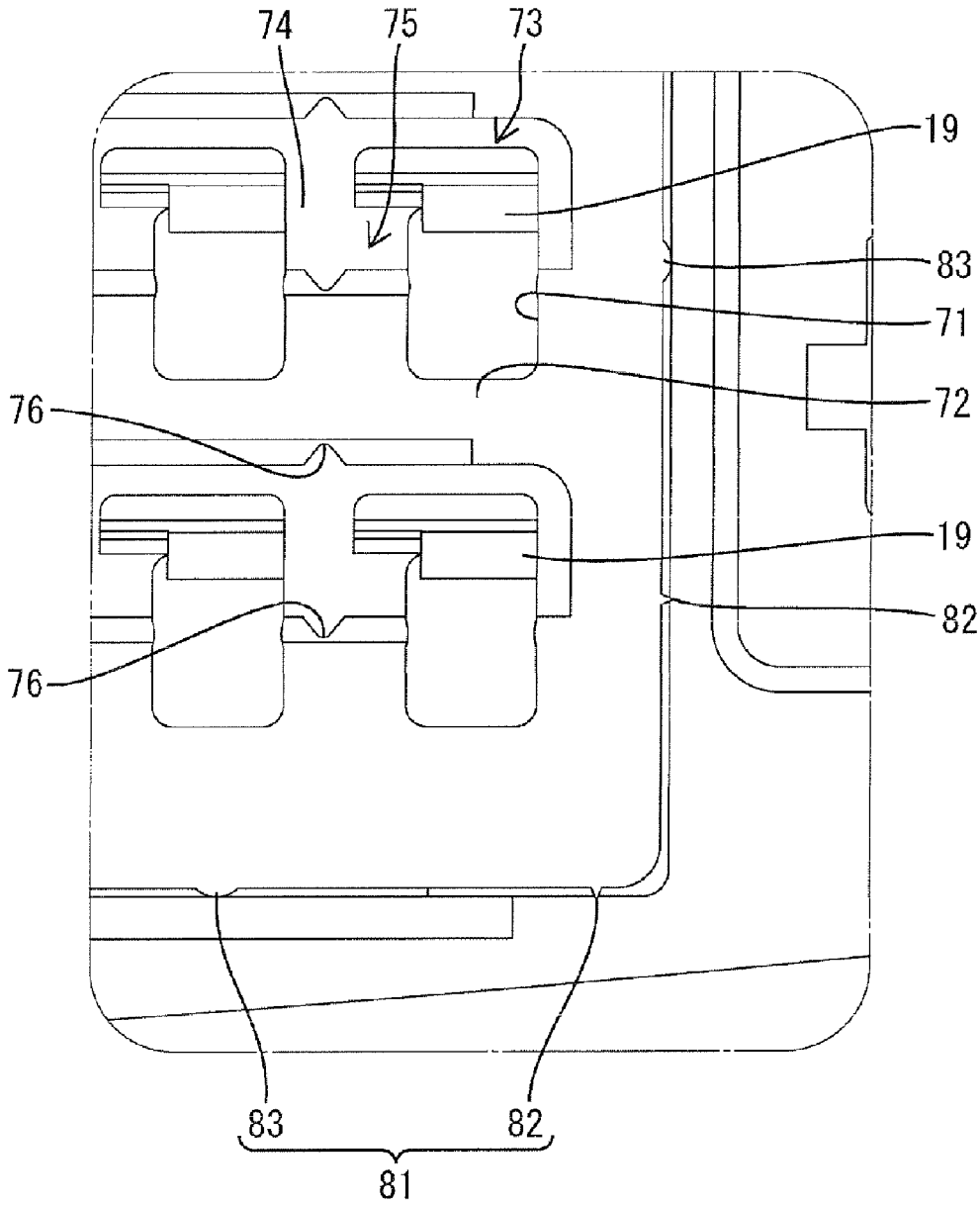
FIG. 7 is an enlarged view of a part A of FIG. 6.

As shown in FIG. 7, stays 72 extend in the width direction in levels of the lance housing 70 above the locking lances 19, and deformation spaces 73 for the locking lances 19 are formed between the stays 72 and the locking lances 19. Openings 74 are defined at outer widthwise sides of each locking lance 19. Partitioning plates 98 on the front holder 90 are insertable into the openings 74 of the respective terminal accommodation holes 71. The partitioning plates 98 are connected with the opposite side walls of the terminal accommodation holes 71 in the rear end of the lance housing 70 to form partition walls at the opposite sides of the terminal fittings 130. The widthwise intermediate part of each locking lance 19 is displaced toward one side from the widthwise center of the terminal accommodation hole 71, and an insertion space 75 for the partitioning plate 98 is formed at the opposite side. Insertion guiding grooves 76 for the partitioning plates 98 are formed by cutting the end edges of the opposite side walls of the terminal accommodation holes 71 and the stays 72 facing these end edges.

Substantially cross-shaped and/or T-shaped connection rib introducing holes 77 penetrate the lance housing 70 in dead spaces between arrays of the terminal accommodation holes 71 and can receive the connection ribs 240 and the locking lances 19. Lance housing locking projections 78 extend in the width direction at the upper and lower ends of the lance housing 70. The lance housing locking projections 78 resiliently deform the upper and lower walls of the accommodation recess 17 outward while the lance housing 70 is inserted into the accommodation recess 17 in the process of assembling the lance housing 70. The lance housing locking projections 78 fit into the lance housing locking grooves 27 as the assembling of the lance housing 70 is completed to prevent resilient deformations of the upper and lower walls of the accommodation recess 17.

Figure 6:
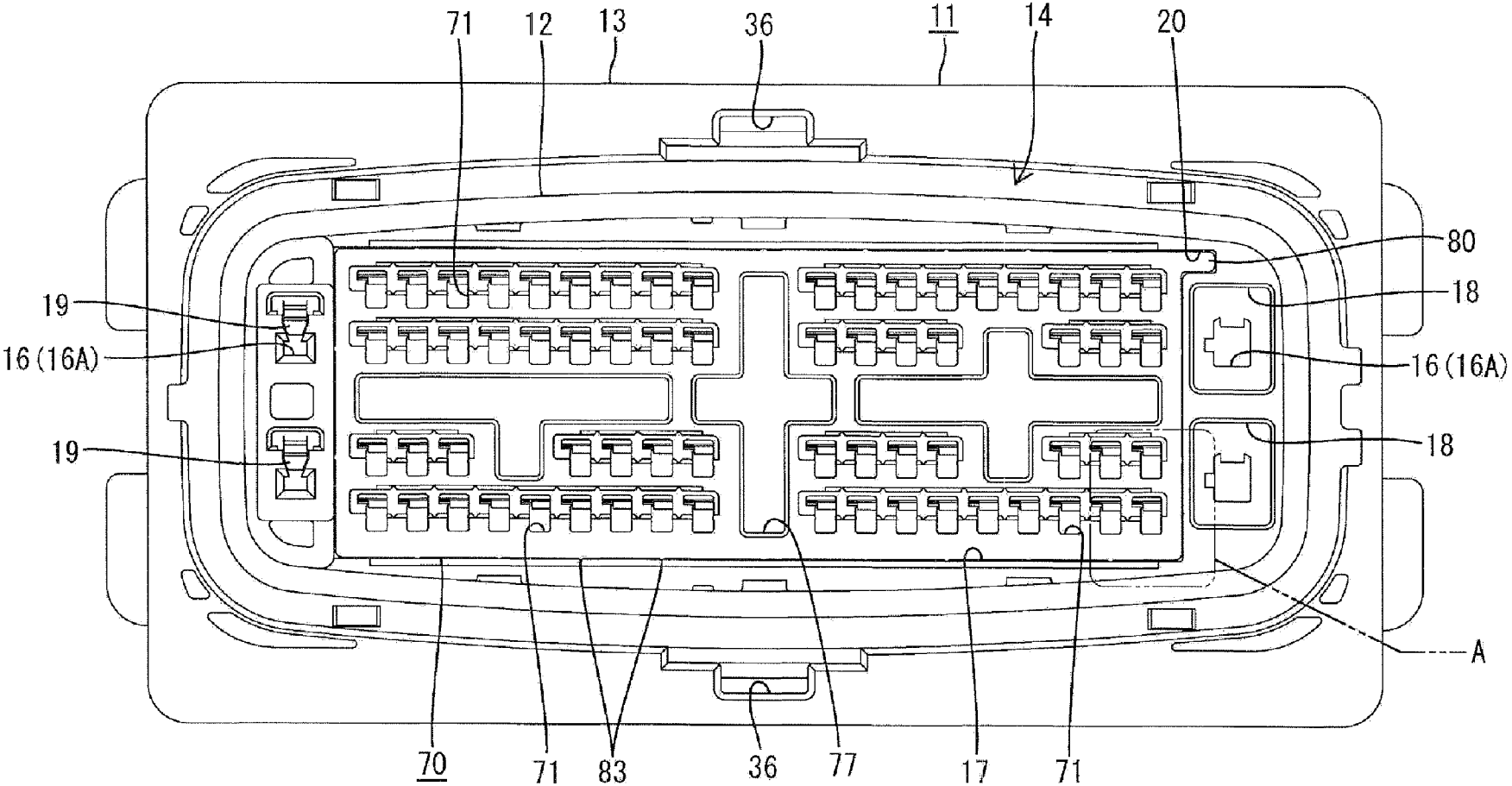
FIG. 6 is a front view showing a state where a lance housing is fit into an accommodation recess of a housing main body.

Second guiding ribs 79 extend laterally at plural levels on the rear surface of the lance housing 70. More particularly, the second guiding ribs 79 are arranged between groups of the terminal accommodation holes 71 and are positioned to face the first guiding ribs 26 with the retainer 50 located therebetween. An error connection preventing rib 80 projects sideways projects from a corner of the outer edge of the lance housing 70. The error connection preventing rib 80 fits into the slit 20 of the housing main body 11 if the lance housing 70 is in a proper assembling posture, as shown in FIG. 6, but interferes with the front surface of the housing main body 11 to prevent any further assembling operation if the lance housing 70 is in a vertically inverted posture. As a result, the error connection preventing rib 80 prevents an erroneous assembling of the lance housing 70.

Projections 81 are provided at spaced apart positions on the outer surface of the lance housing 70 and fill up a clearance between the outer surface of the lance housing 70 and the inner surface of the accommodation recess 17. the projections 81 include main projections 82 with large projecting amounts and auxiliary projections 83 that project less than the main projections 82, as shown in FIG. 7. The main projections 82 are arranged on the two sides defining each of the four corners of the outer edge of the lance housing 70 at positions near the corresponding corner. The auxiliary projections 83 are arranged on the sides at positions more distant from the corners of the outer edge of the lance housing 70. More specifically, two main projections 82 are arranged for each corner of the lance housing 70 so that a total of eight main projections 82 are arranged. Nine auxiliary projections 83 are on each of the longer upper and lower outer surfaces, including the widthwise center. Thus, a total of eighteen auxiliary projections 83 are arranged on the longer surfaces. Two auxiliary projections 83 are arranged at the opposite sides of the vertical center of each of the shorter left and right outer surfaces for a total of four auxiliary projections 83 on the shorter surfaces. The projections 81 are in a positional relationship that is substantially point symmetric to the axial center of the lance housing 70, and the auxiliary projections 83 are arranged at opposite sides of groups of the main projections 82.

Each main projection 82 has an isosceles triangular cross section with a pointed leading end, and extends substantially in forward and backward directions. Additionally, each main projection 82 has a projecting amount larger than the planned spacing between the outer surface of the lance housing 70 and the inner surface of the accommodation recess 17. On the other hand, the auxiliary projections 83 are thicker than the main projections 82 and have a wider cross-section with a rounded leading end that defines a substantially semicircular cross section. Each auxiliary projection 83 extends substantially in forward and backward directions and has substantially the same projecting amount as the planned spacing between the outer surface of the lance housing 70 and the inner surface of the accommodation recess 17. Thus, the leading ends of the main projections 82 are planned to be squashed or deformed by being pressed by the inner surface of the accommodation recess 17. However, the auxiliary projections 83 will contact the inner surface of the accommodation recess 17, but are not planned to be squashed.

Figure 16:
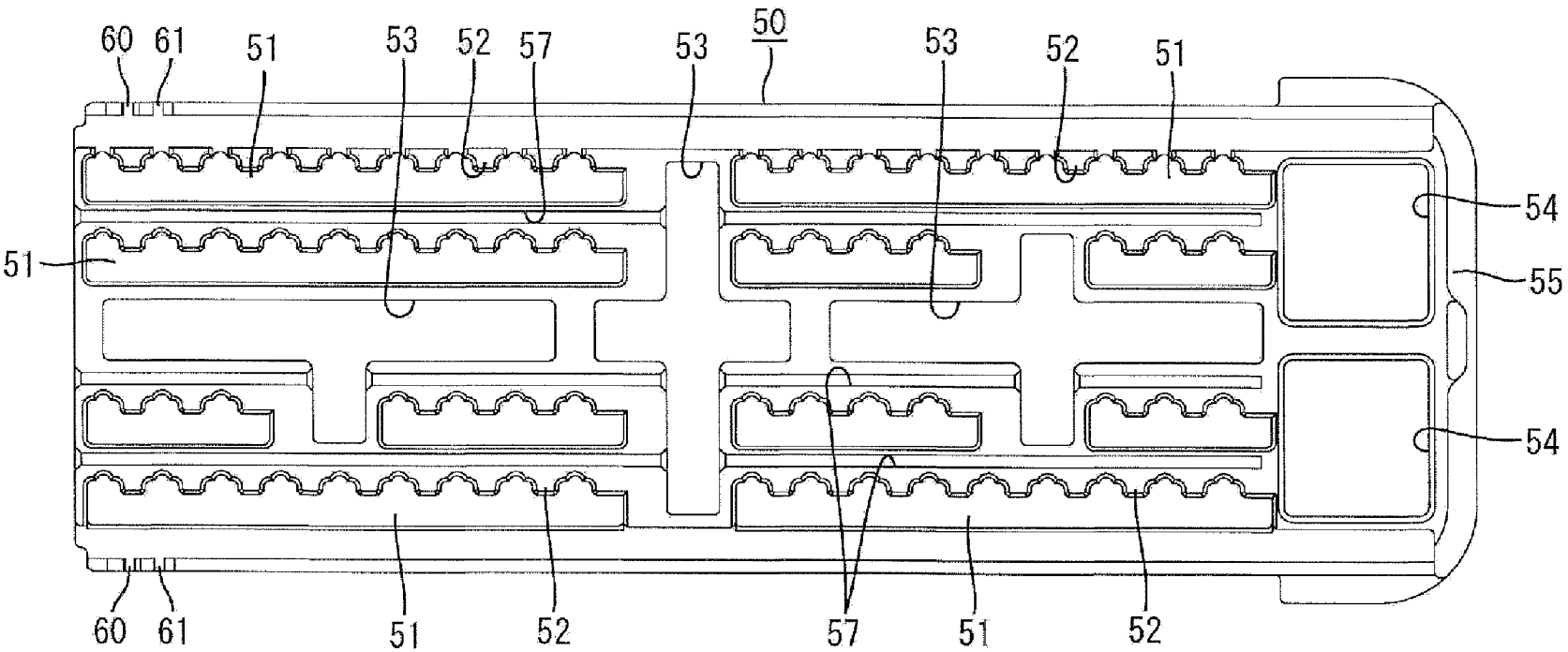
FIG. 16 is a front view of a retainer.

The retainer 50 is a wide plate that is slightly thinner than the lance housing 70 and that corresponds to the shape of the accommodation recess 17 of the housing main body 11, as shown in FIGS. 9 and 16. The retainer 50 is arranged at the front side of the housing main body 11 and behind the lance housing 70. The rear surface of the retainer 50 is held in contact with the back surface of the accommodation recess 17 of the housing main body 11, and the front surface of the retainer 50 is held in contact with the rear surface of the lance housing 70. Windows 51 extend through the retainer and have rear ends that communicate with the small cavities 16B and front ends that communicate with the terminal accommodation holes 71. The windows 51 are arranged in levels that extend in the width direction. Retaining projections 52 project from edges of the windows 51 at positions corresponding to the small cavities 16B and the terminal accommodation holes 71. The retainer 50 is inserted into the accommodation recess 17 through the retainer introducing hole 37 and the retainer insertion hole 23 and is movable in a width direction crossing an inserting direction of the terminal fittings 130 into the cavities 16. The retainer 50 can be moved between the partly locked position and the fully locked position in the accommodation recess 17. The retaining projections 52 are retracted from the small cavities 16B when the retainer is at the partly locked position to permit the insertion of the terminal fittings 130 into the terminal accommodation holes 71. However, the retaining projections 52 project into the small cavities 16B and engage rear ends of the box portions 131 of the properly inserted terminal fittings 130 when the retainer is at the fully locked position to achieve secondary locking of the terminal fittings 130.

Cross-shaped and/or T-shaped connection rib passage holes 53 penetrate the lance housing 70 in dead spaces between the window holes 51 in the respective levels and can receive the connection ribs 240. Rear ends of the connection rib passage holes 53 communicate with the connection rib insertion holes 21 and front ends thereof communicate with the connection rib introducing holes 77. Upper and lower tower insertion holes 54 are formed at one widthwise end of the retainer 50 and can receive the cavity towers 95 of the front holder 90. A part of the retainer 50 formed with the tower insertion holes 54 defines an operable portion 55, and the operable portion 55 makes the entire retainer 50 wider than the lance housing 70 so that the retainer 50 projects more laterally than the lance housing 70. The operable portion 55 enters the retainer insertion hole 23 of the housing main body 11 as the retainer 50 is assembled. Thus, the tower insertion holes 54 communicate with the tower mounting windows 18. The cavity towers 95 are inserted loosely into the tower insertion holes 54, and the retainer 50 is movable between the partly locked position and the fully locked position in a state where the cavity towers 95 penetrate the tower insertion holes 54.

First guiding grooves 56 extend in the width direction along the rear surface of the retainer 50 at positions above and below the window holes 51 for engaging the first guiding ribs 26 of the housing main body 11. Second guiding grooves 57 extend in the width direction along the front surface of the retainer 50 at positions above and below the window holes 51 in the respective levels for engaging the second guiding ribs 79 of the lance housing 70. The first and second guiding grooves 56, 57 are in a back-to-back positional relationship and are at substantially the same heights.

Upper and lower connecting protrusions 58 extend in the width direction at positions on the upper and lower ends of the retainer 50 aligned with the rail grooves 24 of the housing main body 11. Each connecting protrusion 58 includes a rail projection 59 that can fit into the rail groove 24. The retainer 50 is retained in the housing main body 11 by engaging the rail grooves 24 and rail projections 59. Front and rear first locking grooves 60 and front and rear second locking grooves 61 are formed successively from the leading end of the connecting protrusion 58 with respect to the inserting direction of the retainer 50. The first locking grooves 60 engage resiliently with the retainer holding projections 25 to hold the retainer 50 at the partly locked position, and the second locking grooves 61 engage resiliently with the retainer holding projections 25 to hold the retainer 50 at the fully locked position.

Figure 8:
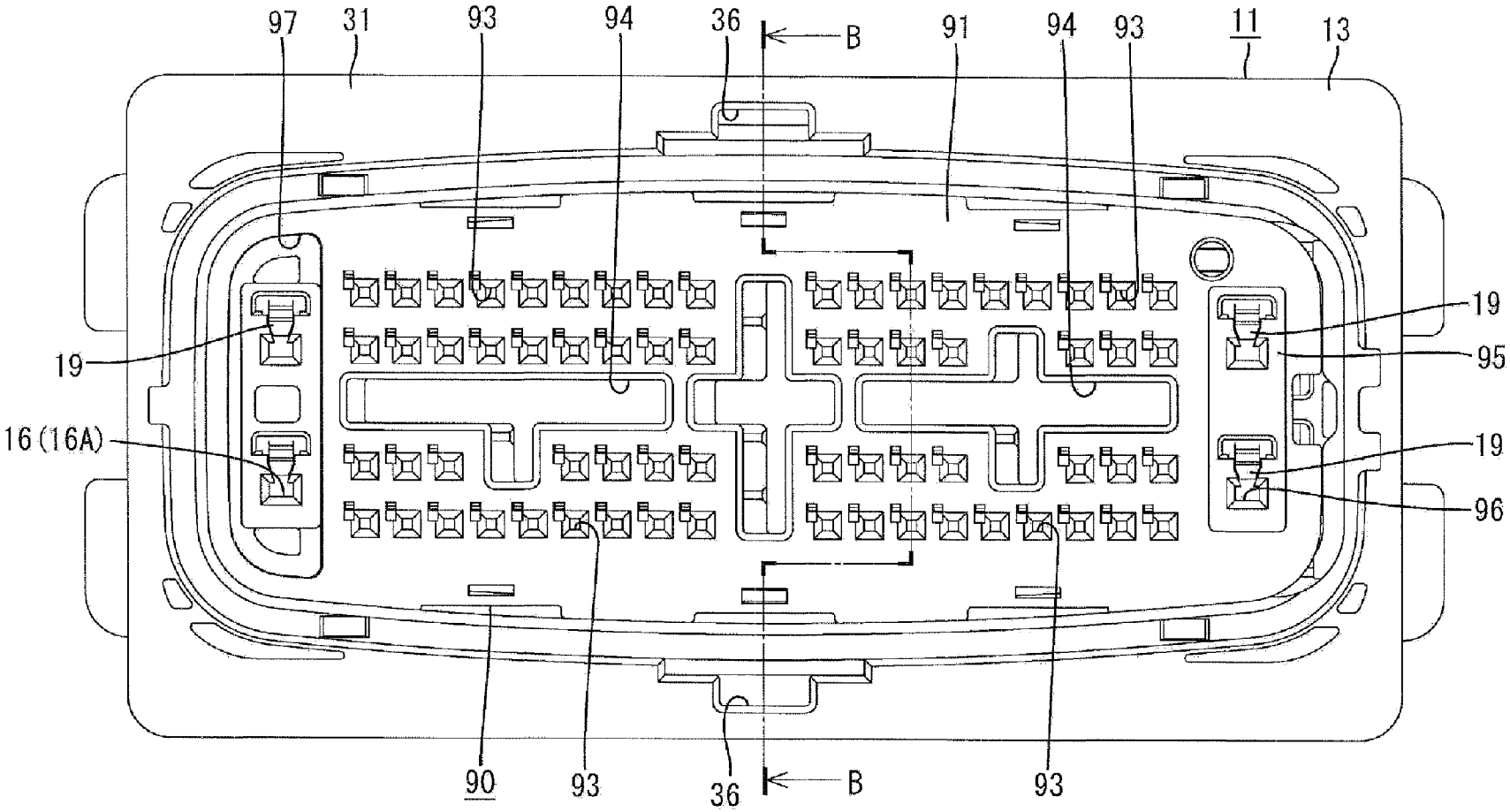
FIG. 8 is a front view of a connector.

The front holder 90 is substantially cap-shaped and includes a front wall 91 in the form of a substantially flat plate to be mounted to the front surface of the lance housing 70 for covering the front ends of the locking lances 19. A substantially tubular peripheral wall 92 projects back from the periphery of the front wall 91 to fitted on the terminal inserting portion 12, as shown in FIGS. 8 and 9. The front wall 91 is formed with tab introducing holes 93 at positions corresponding to the terminal accommodation holes 71 of the lance housing 70. The tab introducing holes 93 can receive tabs 231 of the male terminal fittings 230 mounted in the mating connector 200. Cross-shaped and/or T-shaped connection rib receiving holes 94 penetrate the front wall 91 and can receive the connection ribs 240. In an assembled state, the connection rib receiving holes 94, the connection rib introducing holes 77, the connection rib passage holes 53 and the connection rib insertion holes 21 are positioned successively from the front side and communicate with each other.

Rectangular tubular upper and lower cavity towers 95 project back a large distance from one widthwise end part of the front wall 91 and project forward a shorter distance. The cavity towers 95 are formed with terminal holding holes 96 that penetrate through the tower mounting windows 18 and the tower insertion holes 54 and communicate with the large cavities 16A of the housing main body 11. A resiliently deformable locking lance 19 is provided at an inner surface of each terminal holding hole 96 for locking the large terminal fitting 130. Further, an escaping window 97 is formed at the other widthwise end part of the rear surface of the front wall 91 for collectively accommodating the leading ends of the large cavities 16A including the locking lances 19.

Thick vertical partitioning plates 98 project back from the rear surface of the front wall 91 at positions lateral to the respective terminal introducing holes 93. The partitioning plates 98 form partition walls between the terminal fittings 130 together with the opposite side walls of the terminal accommodation holes 71 upon assembling the front holder 90. Thus, large widths can be ensured for the locking lances 19. A plurality of front holder locking projections 101 are provided on the opposite upper and lower inner surfaces of the peripheral wall 92 while being spaced apart in the width direction, and the front holder 90 is retained in the housing main body 11 by the resilient engagement of the front holder locking projections 101 with the front holder locking grooves 28.

Assembly of the connector 10 initially requires the lance housing 70 to be inserted into the accommodation recess 17 of the housing main body 11 from the front. As a result, the lance housing locking projections 78 engage the lance housing locking grooves 27 to hold the lance housing 70 in the housing main body 11. The inner surface of the accommodation recess 17 squashes and deforms the leading ends of the main projections 82 during assembly of the lance housing 70. Additionally, the auxiliary projections 83 are held in contact with the inner surface of the accommodation recess 17, as shown in FIGS. 6 and 7. Therefore, the lance housing 70 is assembled in a proper posture without being inclined about the axial center.

The part of retainer 50 with the windows 51 then is inserted into the accommodation recess 17 via the retainer introducing hole 37 and the retainer insertion hole 23 so that the operable portion 55 enters the retainer introducing hole 37. As a result, the front surface of the retainer 50 contacts the rear surface of the lance housing 70 and the rear surface of the retainer 50 contacts the back surface of the accommodation recess 17 of the housing main body 11. The first locking grooves 60 engage the retainer holding projections 25 to hold the retainer 50 at the partly locked position. The front holder 90 then is assembled so that the front wall 91 of the front holder 90 covers the front surface of the lance housing 70. Accordingly, the cavity towers 95 enter the tower insertion holes 54 and the tower mounting windows 18, so that the cavity towers 95 communicate with the large cavities 16A. The locking action of the front holder locking projections 101 and the front holder locking grooves 28 retain the front holder 90 in the housing main body 11. The assembly of the front holder 90 positions the tab introducing holes 93, the terminal accommodation holes 71, the windows 51 and the small cavities 16B one after another in this order from the front and in the widthwise intermediate part of the terminal inserting portion 12.

Assembly proceeds by inserting terminal fittings 130 into the cavities 16 from behind, as shown in FIG. 9. At this time, the boxes 131 of the small terminal fittings 130 are accommodated in the terminal accommodation holes 71 via the small cavities 16B and the windows 51 and contact the edges of the rear surfaces of the terminal introducing holes 93 so as not to move any farther forward. The locking lances 19 then achieve primary locking of the terminal fittings 130.

The lever 110 is assembled before or after the above-described assembling operations. More particularly, the arm plates 112 of the lever 110 are inserted into the arm plate insertion spaces 33 of the mount recess 32 and the first lever locks 125 engage the lever interlocking portions at the shallow position of the mount recess 32 to hold the lever 110 at the standby position. The entrances of the cam grooves 114 communicate with the follower pin introducing grooves 36 and face the front end of the housing main body 11 when the lever 110 is at the standby position. Thus, the follower pins 250 can be received. Further, the seal ring 140 is mounted on the outer surface of the terminal inserting portion 12.

Figure 5:
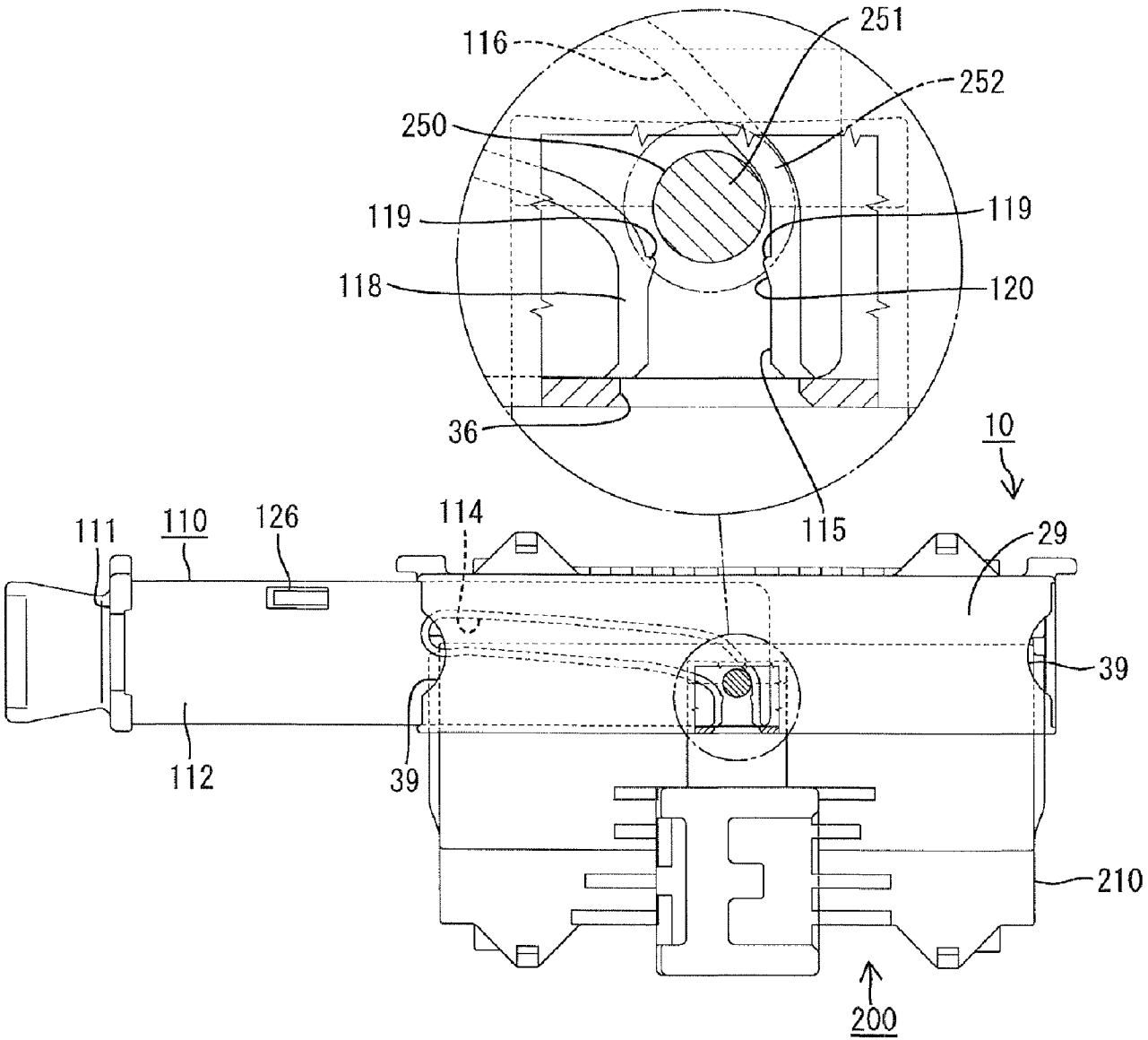
FIG. 5 is a plan view partly section showing the follower pins moved over protuberances and the partly connected state released.

The housing 150 is fit lightly into the receptacle 220 of the mating housing 210 after all of the terminal fittings 130 are inserted. Then, as shown in FIG. 4, the follower pins 250 of the mating connector 200 enter the introducing portions 115 through the entrances of the cam grooves 114 and simultaneously contact the protuberances 119. Thus, the connecting operation is prevented temporarily and the two housings 150, 210 are left partly connected. In this state, the lever 110 is displaced toward the connection position by holding the grip 113 thereof. Then, as shown in FIG. 5, the follower pins 250 move over the protuberances 119 and into the acting portions 116. The lever is pushed farther and produces a cam action between the follower pins 250 and the groove surfaces of the acting portions 116 for connecting two housings 150, 210. An operator can obtain an operation feeling when the follower pins 250 move over the protuberances 119 and release the two housings 150, 210 from the partly connected state.

The receptacle 220 is inserted into the connection space 14 of the housing main body 11 in the process of connecting the two housings 150, 210, and the connection ribs 240 penetrate through the connection rib receiving holes 94, the connection rib introducing holes 77, the connection rib passage holes 53 and the connection rib insertion holes 21 to guide the connecting operation of the housings 150, 210. The seal ring 140 provides sealing between the housings 150, 210 and the terminal fittings 130, 230 are connected to proper depths to establish electrical connections with each other when the lever 110 reaches the connection position and the two housings 150, 210 are connected properly. Further, the operable plate 111 of the lever 110 is held in contact with the mounting surface 35 of the mount recess 32, the forced connection preventing portions 40 of the mount recess 32 are fit into the escaping portions 122 of the reinforcements 121 and the intermediate ribs 123 enter the grooves 41 of the forced connection preventing portions 40.

The connection ribs 240 protect portions of the tabs 231 projecting into the receptacle 220. More particularly, a corner of the front end of the tubular fitting 13 normally interferes with the connection rib 240 to prevent deformations of the tabs 231 if the housing 150 is inclined improperly. However, there is a fear that the housing 150 could have an improper posture that might permit the connection rib 240 to enter along the curved surface 34 of the mount recess 32. Thus, there is a fear that the connection rib 240 may erroneously enter the mount recess 32 and the corner of the front end of the tubular fitting 13 may interfere with the tabs 231 to deform the tabs 231, as shown in a reference diagram of FIG. 3. However, the forced connection preventing portions 40 are provided on the curved surfaces 34 of the mount recess 32. Thus, if the housing 150 is in an improper posture, the connection rib 240 interfere with the forced connection preventing portion 40 before entering the mount recess 32, as shown in FIG. 2, and a forced connection is prevented.

The reinforcements 121 are provided on the corners where the operable plate 111 is connected with the arm plates 112. Thus, the strength of the lever 110 is increased. On the other hand, the curved surfaces 34 are formed on the mounting surfaces 35 of the mount recess 32 in correspondence with the reinforcements 121, and recesses extend along the curved surfaces 34 near the corners at the opposite ends of the housing 150. Thus, there is a fear that a projection of the mating connector, such as the connection rib 240, may enter such a recess and deform the terminal fittings 130 due to forced connection attempt while the housing 150 is in an improper posture. However, no such recesses are formed since the forced connection preventing portions 40 project from the curved surfaces 34 of the mount recess 32. Therefore the forced connection of the connectors is prevented. In addition, the escaping portions 122 are formed in the reinforcements 121 for receiving the forced connection preventing portions 40. The forced connection preventing portions 40 avoid losing the entire reinforcing portions 121 and the strength of the lever 110 is not reduced. Further, the forced connection preventing portions 40 are provided inside the housing main body 11 and do not enlarge the connector.

The forced connection preventing portions 40 are formed with the grooves 41 and the intermediate ribs 123 in the escaping portions 122 of the reinforcements 121 are insertable into the respective grooves 41. The intermediate ribs 123 and the reinforcements 121 ensure that the strength of the lever 110 is not reduced.

The grooves 41 are narrower than the mating connection ribs 240. Thus, there is no likelihood that the connection ribs 240 erroneously enter the grooves 41 and, hence forced connection of the connectors is prevented.

The protuberances 119 are arranged on the groove surfaces at opposite sides of each cam groove 114 and are equidistant from the entrance of the cam groove 114. Thus, the protuberances contact the corresponding follower pin 250 at substantially the same time so that substantially equal pressing forces are given to the follower pin 250 from the opposite sides. As a result, the connecting postures of both housings 150, 210 remain proper and both housings 150, 210 are prevented from being obliquely connected. Further, the protuberances 119 are provided on the groove surfaces at the opposite sides of each cam groove 114. Thus, the projecting amount of the protuberances 119 is reduced as compared with the case where the projection is provided only on the groove surface at one side. Therefore, leading ends of the protuberances 119 are not squashed.

The main projections 82 are in a squashed or deformed state between the outer surface of the lance housing 70 and the inner surface of the accommodation recess 17 when the lance housing 70 is accommodated in the accommodation recess 17 of the housing main body 11. Thus, the clearance between the two surfaces is filled sufficiently to prevent the lance housing 70 from shaking. The auxiliary projections 83 have smaller projecting amounts, are provided separately from the main projections 82 and are arranged so that their leading ends contact the inner surface of the mating accommodation recess 17 without being squashed. Thus, the squashed amounts of the main projections 82 are specified by a height difference between the main projections 82 and the auxiliary projections 83. The auxiliary projections 83 have a size, cross-section and/or resiliency to substantially prevent deformation when the lance housing 70 is accommodated properly in the accommodation recess 17. Therefore, a variation in the squashed amounts of the main projections 82 can be avoided. In addition, the auxiliary projections 83 are not planned to be squashed, thereby decreasing the assembling load and improving operability.

The main projections 82 and the auxiliary projections 83 are a distance from each other. Thus, squashed pieces are permitted to escape between the main projections 82 and the auxiliary projections 83. More particularly, the squashed pieces do not adhere to the auxiliary projections 83 since there is a sufficient clearance for permitting the squashed pieces to escape between the main projections 82 and the auxiliary projections 83. Accordingly, there is no likelihood of varying a height difference between the auxiliary projections 83 and the main projections 82 due to the adhesion of the squashed pieces to the auxiliary projections 83.

The main projections 82 are near the corners of the accommodation recess 17 and the lance housing 70 and at the opposite positions of the corners. Thus, shaking is suppressed at the corners, which are unlikely to be influenced by deflection and the like during molding and dimensional accuracy is obtained. As a result, accuracy and reliability in suppressing the shaking are improved. It is sufficient to arrange the main projections 82 at positions near one corner portion and at the opposite sides of this corner.

The main projections 82 and the auxiliary projections 83 need not be arranged over the entire periphery of the lance housing 70. For example, the main projections 82 and the auxiliary projections 83 may be only on opposite upper and lower surfaces of the lance housing 70 if it is desired to eliminate vertical shaking of the lance housing 70, and the main projections 82 and/or the auxiliary projections 83 may be only on the opposite left and right surfaces of the lance housing 70 if it is desired to eliminate the lateral shaking of the lance housing 70. Further, for example, the main projections 82 and the auxiliary projections 83 may be only on the upper surface of the lance housing 70 if it is desired to eliminate the upward shaking of the lance housing 70, and the main projections 82 and the auxiliary projections 83 may be only on the right surface of the lance housing 70 if it is desired to eliminate rightward shaking of the lance housing 70. In short, the main projections 82 and the auxiliary projections 83 may be arranged only on the surface substantially facing in a direction required to have the shaking prevented by filling up the clearance between the outer surface of the lance housing 70 and the inner surface of the accommodation recess 17. Thus, an increase of the assembling load can be reduced further while the shaking is suppressed reliably.

If the clearance between the outer surface of the lance housing 70 and the inner surface of the accommodation recess 17 includes a wider area where the distance between the two surfaces is longer, for example, because another part is provided between the two surfaces and a narrower area where the distance between the two surfaces is shorter, i.e. if the distance between the two surfaces is not uniform, the main projections 82 and the auxiliary projections 83 preferably are arranged in the narrower area. This is because the respective projecting amounts of the main projections 82 and the auxiliary projections 83 are reduced in addition to reducing the increase of the assembling load.

The main projections 82 and the auxiliary projections 83 suppress shaking between the housing main body 11 and the lance housing 70 and hence prevent misalignment of the terminal fittings 130 accommodated in the lance housing 70.

The rear surface of the lance housing 70 and the front surface of the retainer 50 contact each other. Thus, a front end portion of the housing main body 11 is not provided between the lance housing 70 and the retainer 50 and the length of the connector 10 is shortened in forward and backward directions.

The retainer 50 is positioned in the housing main body 11 by the retainer holding projections 25 and not in the lance housing 70. Thus, the assembled position of the retainer 50 into the housing main body 11 is proper even if the lance housing 70 is displaced from a proper position in the housing main body 11. As a result, the retaining portions 52 of the retainer 50 reliably face the rear ends of the box portions 131 of the terminal fittings 130 at the fully locked position, and a reliable locking function of the retainer 50 is ensured.

The lance housing 70 is positioned in the housing main body 11 by the lance housing locking grooves 27. Thus, the lance housing 70 is not displaced following a movement of the retainer 50 and the stability of the movement of the retainer 50 is ensured even if the lance housing 70 an the retainer 50 come into contact.

The second guiding ribs 79 of the lance housing 70 slide smoothly along the second guiding grooves 57 of the retainer 50 during the movement of the retainer 50. The engagement of the second guiding ribs 79 and the second guiding grooves 57 prevent relative displacements of the retainer 50 and the lance housing 70 after the retainer 50 is assembled.

The first guiding ribs 26 of the housing main body 11 slide smoothly along the first guiding grooves 56 of the retainer 50 during movement of the retainer 50. The engagement of the first guiding ribs 26 and the first guiding grooves 56 prevent relative displacements of the retainer 50 and the housing main body 11 after the retainer 50 is assembled. The lance housing 70 is positioned following the retainer 50.

Figure 19:
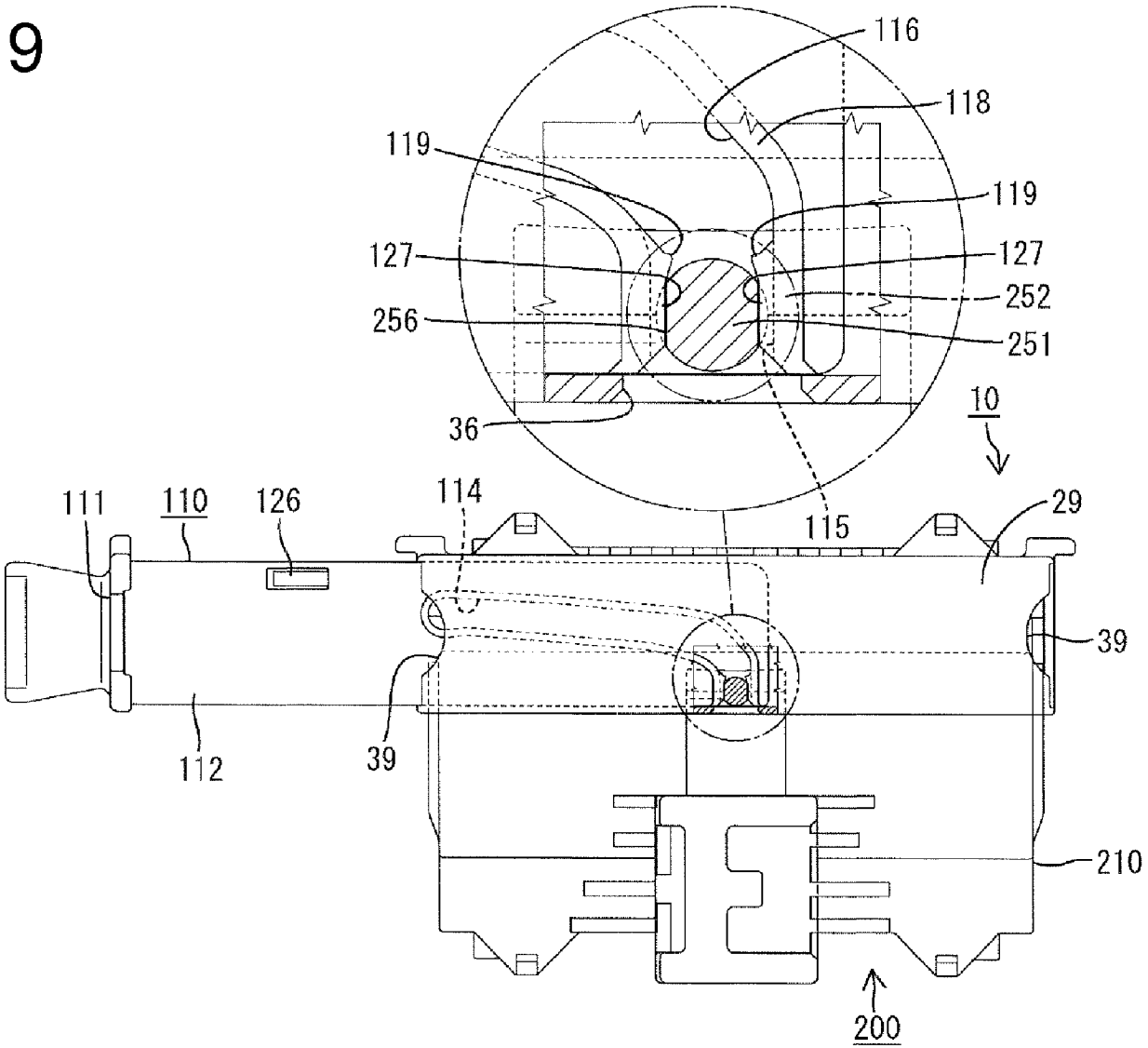
FIG. 19 is a plan view partly in section showing follower pins are in introducing portions of cam grooves and two housings left partly connected in a second embodiment.
Figure 20:
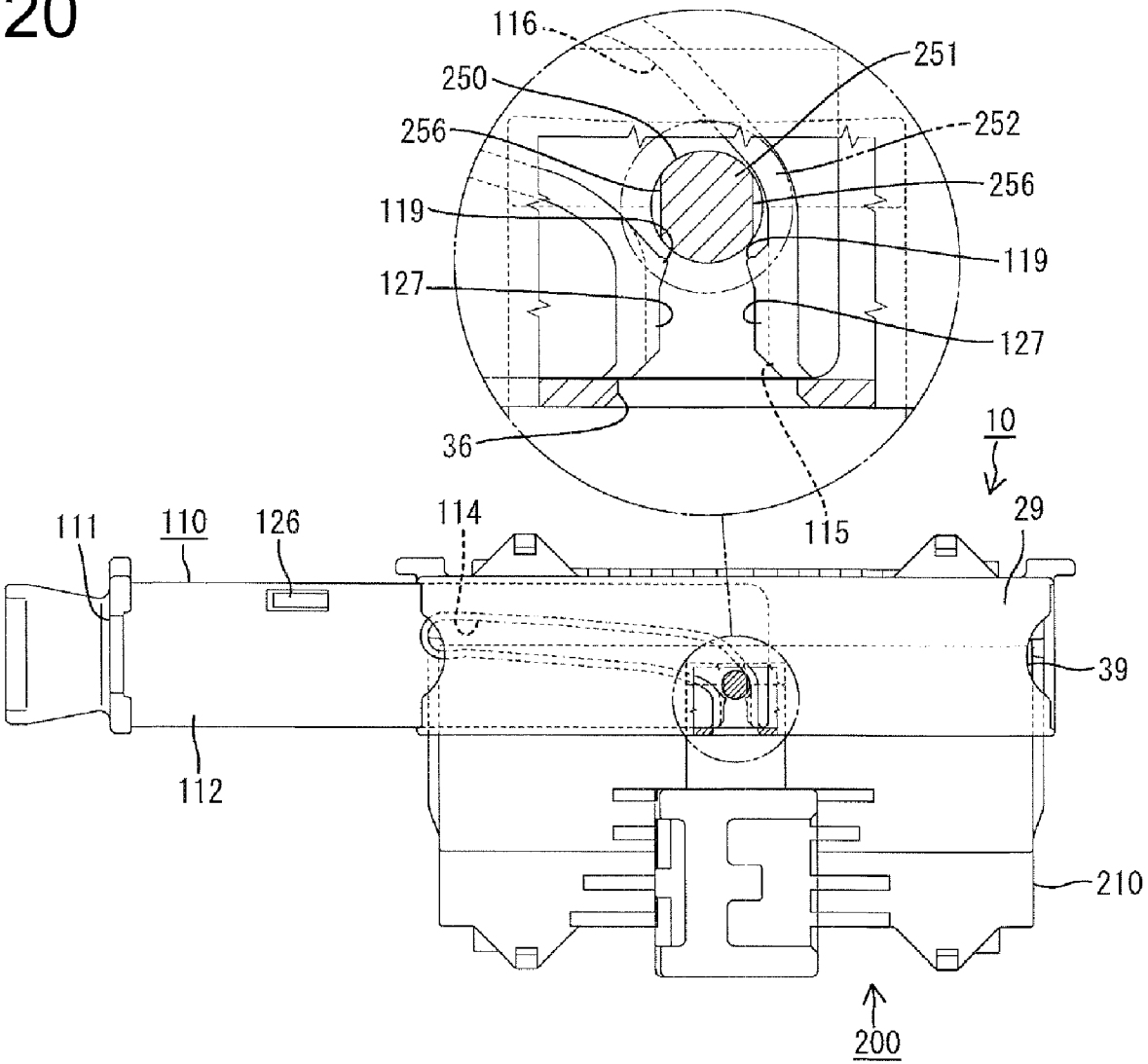
FIG. 20 is a plan view partly section showing a state where the follower pins move over protuberances to release the partly connected state.
Figure 21:
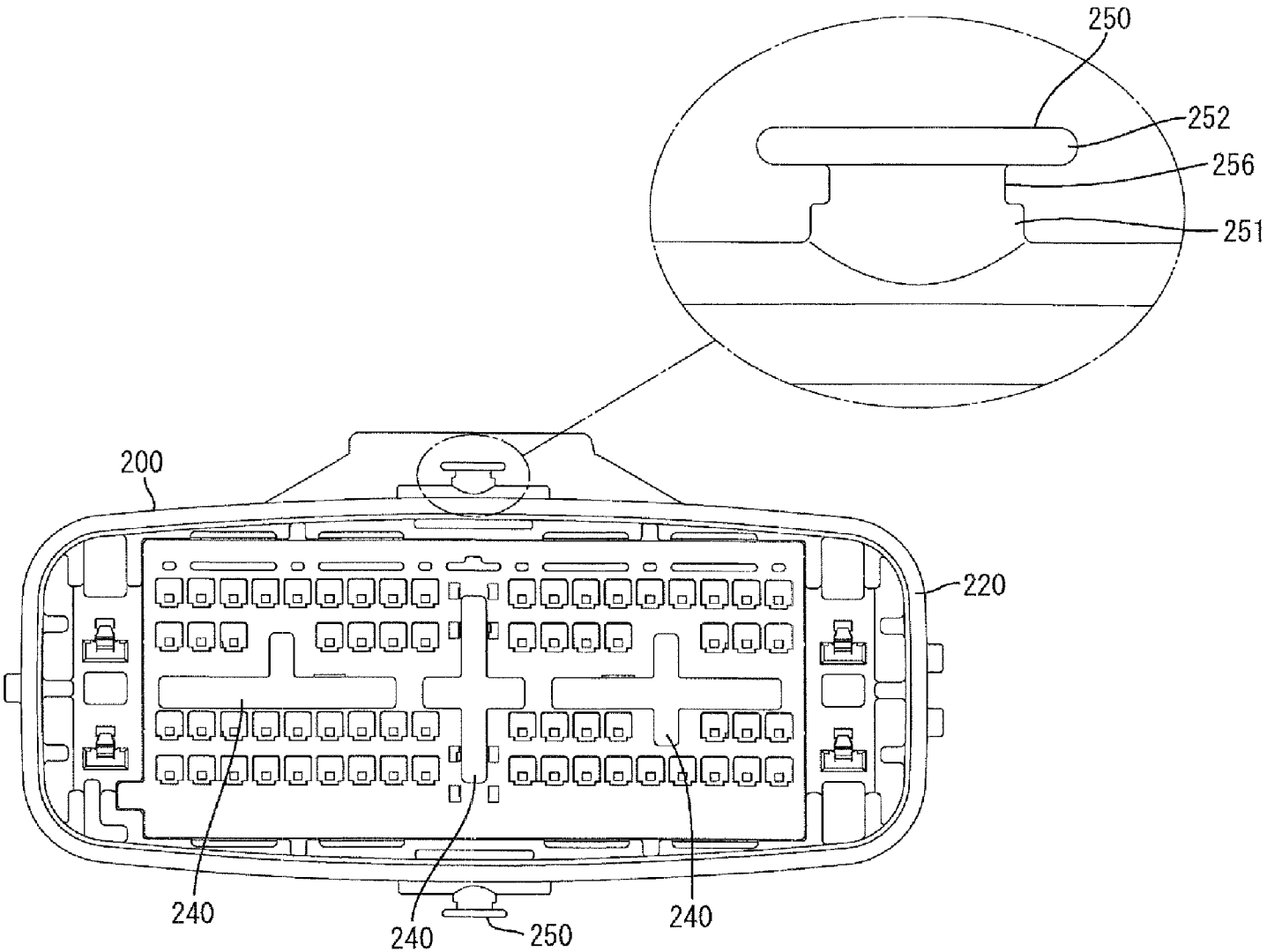
FIG. 21 is a front view of a mating housing with a follower pin.

A second embodiment of the invention is described with reference to FIGS. 19 to 21. The second embodiment differs from the first embodiment in the shape of the introducing portions 115 of the cam grooves 114, but is similar to the first embodiment in other points. Accordingly, parts structurally identical to those in the first embodiment are identified by the same reference numerals and are not repeatedly described.

In each cam groove 114 of a lever 111, the groove surfaces of an introducing portion 115 are raised in a direction to narrow the groove width to form a pair of straight receiving portions 127 having inner surfaces extending substantially straight in forward and backward directions. The spacing between the two straight receiving portions 127 is kept at a fixed distance over substantially the entire length in forward and backward directions. The straight receiving portions 127 are at a front side with respect to a depth direction of the cam groove 114, and two protuberances 119 project in at ends of the straight receiving portions 127 distant from the entrance of the cam groove 114. The protuberances 119 are substantially equidistant from the entrance of the cam groove 114 and have shapes similar to the first embodiment.

Each mating follower pin 250 includes a substantially cylindrical shaft 251 and a flange 252 bulges out from the leading end of the shaft 251 over substantially the entire circumference (similar to the first embodiment in this point as well). A neck-shaped straight portion 256 having outer surfaces extending substantially straight in forward and backward directions is formed right below the flange 252 by cutting the opposite widthwise ends. The width of the straight portion 256 is set to be substantially equal to the spacing between the two straight receiving portions 127.

Accordingly, when two housings 150, 210 are connected lightly to reach a partly connected state, the follower pins 250 enter the introducing portions 115 of the cam grooves 114. At this time, the straight portions 256 and the straight receiving portions 127 come into contact along straight lines in a connecting direction. Thus, connecting postures of the two housings 150, 210 will not incline about the shafts 251. Further, when the follower pins 250 move over or past the protuberances 119 by a sliding movement of the lever 110 toward a connection position, the straight portions 256 and the straight receiving portions 127 come into sliding contact with each other to guide movements of the follower pins 250 and the straight portions 256 slide on the protuberances 119 to have substantially equal pressing forces given from the opposite sides. Thus, the inclination of the connecting posture of the housing 150 at this time is prevented. In other words, by preferably providing the straight receiving portions 127 between the introducing portions 115 of the cam grooves 114 and the protuberances 119, substantially straight insertion paths extending in the connector connecting direction can be defined until the follower pins 250 contact the protuberances 119 after being inserted into the cam grooves 114. These insertion paths act only at the time of starting a connector connecting operation (inserting the follower pins 250 into the cam grooves 114).

Figure 22:
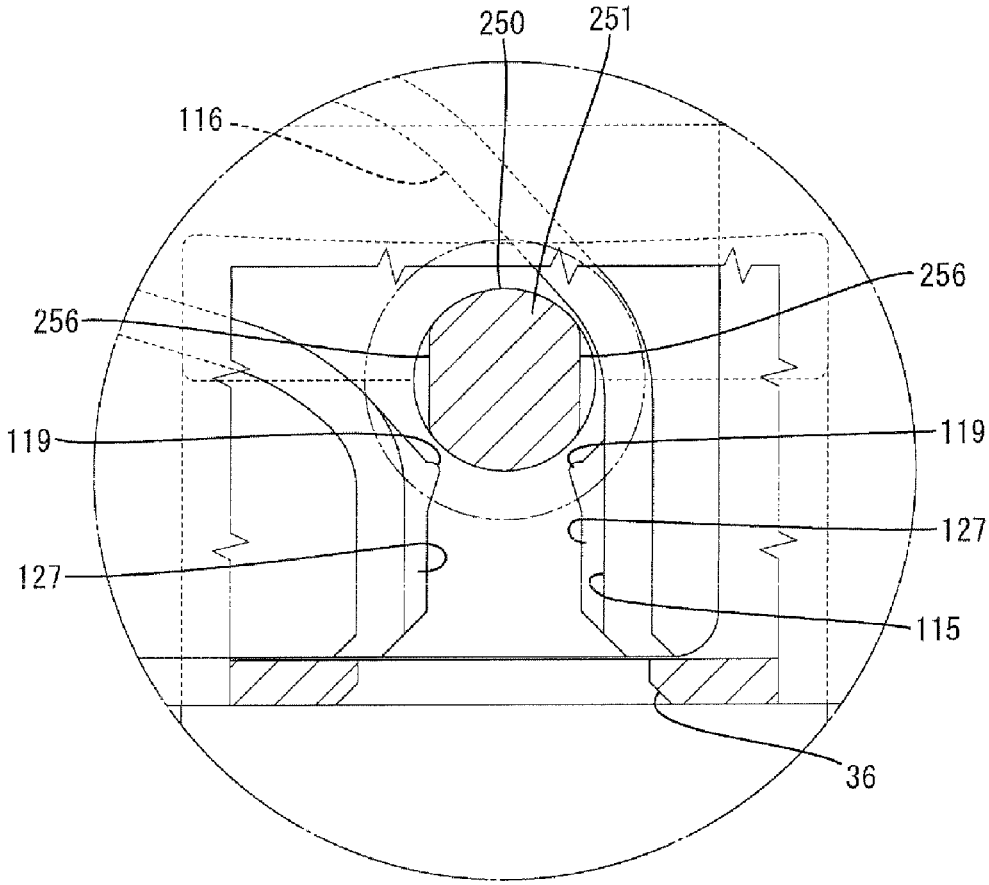
FIG. 22 is a plan view partly section showing follower pins in introducing portions of cam grooves and two housings left partly connected in a third embodiment.
Figure 23:
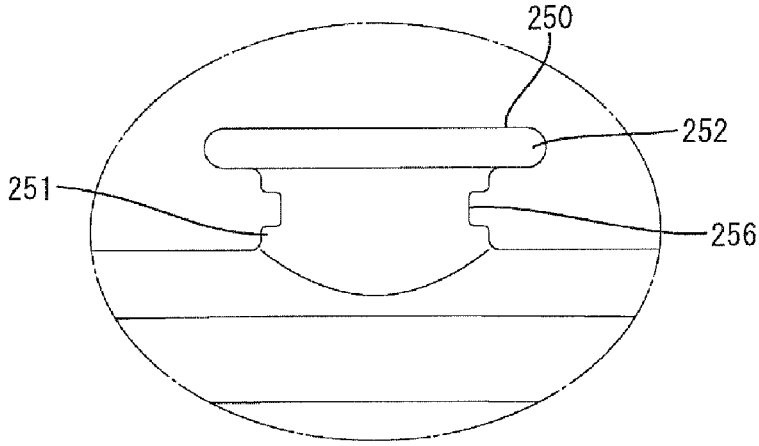
FIG. 23 is an enlarged front view of the follower pin.

FIGS. 22 and 23 show a third preferred embodiment of the invention. The third embodiment differs from the second embodiment in that straight receiving portions 127 are arranged at back sides with respect to depth directions of cam grooves 114 and straight portions 256 are arranged in middle parts of shaft portions 251 in a height direction distant from flange portions 252. The third embodiment is similar to the second embodiment in other points.

The invention is not limited to the above described and illustrated embodiments. For example, the following embodiments are also embraced by the technical scope of the present invention as defined by the claims.

The forced connection preventing portions can have any shape so long as they can prevent the forced connection of the two housings.

The grooves may be omitted from the forced connection preventing portions and the intermediate ribs may be omitted from the reinforcements.

The projections (main projections and auxiliary projections) may be provided on the inner surface of the accommodation recess.

The projections (main projections and auxiliary projections) may be mixedly provided on the outer surface of the lance housing and the inner surface of the accommodation recess.

The projections (main projections and auxiliary projections) may be provided on at least either one of the inner surface of the front holder and the outer surface of the terminal inserting portion.

If an inner housing is accommodated into an accommodation recess of an outer housing, projections (main projections and auxiliary projections) may be provided on at least one of the inner surface of the outer housing and the outer surface of the inner housing.

Mating surfaces engageable with the projections (main projections and auxiliary projections) may not be flat and may be groove-shaped so that the projections are fittable therein. In this way, the projections are held positioned.

The front holder may be omitted from the connector housing.

The first and second guiding ribs and the first and second guiding grooves may be dispensed with.

The housing main body and the lance housing may constitute a male connector housing, into which male terminal fittings are mountable.

The lever may be mounted into a male connector housing, into which male terminal fittings are mountable. The lever may be operated along a different path than a substantially linear to display a cam action e.g. along a circular path (i.e. the lever may be pivotably or rotatably displaced).

In the second and third embodiments, the straight receiving portions may be arranged over the entire depths of the cam grooves and the straight portions may be arranged over the entire heights of the shaft portions.

The cam grooves may be formed as bottomed grooves.

The invention is also applicable to non-watertight connectors.

What is claimed is:

1. A connector, comprising:

a housing main body including one or more cavities, into which one or more respective terminal fittings are at least partly insertable, a lance housing to be located at a front side of the housing main body and including one or more terminal accommodation holes, which will communicate with the respective cavities, and one or more locking lances resiliently deformably projecting at the terminal accommodation holes to primarily lock the terminal fittings at least partly accommodated in the terminal accommodation holes, and a retainer to be located behind the lance housing and movable to a first position for permitting the insertion of the terminal fittings into the terminal accommodation holes and to a second position for secondarily locking the terminal fittings, wherein the rear surface of the lance housing and the front surface of the retainer are arranged in contact with each other.

2. The connector of claim 1, wherein the plate-like retainer is mountable through a side surface of the housing main body.

3. The connector of claim 1, wherein the housing main body includes retainer positioning means for positioning the retainer.

4. The connector of claim 1, wherein the housing main body includes lance housing positioning means for positioning the lance housing.

5. A connector, comprising:

a housing main body including one or more cavities, into which one or more respective terminal fittings are at least partly insertable, a lance housing to be located at a front side of the housing main body and including one or more terminal accommodation holes, which will communicate with the respective cavities, and one or more locking lances resiliently deformably projecting at the terminal accommodation holes to primarily lock the terminal fittings at least partly accommodated in the terminal accommodation holes, a retainer to be located behind the lance housing and movable to a first position for permitting the insertion of the terminal fittings into the terminal accommodation holes and to a second position for secondarily locking the terminal fittings, wherein the rear surface of the lance housing and the front surface of the retainer are arranged in contact with each other, and wherein at least one guiding groove extending substantially in a moving direction of the retainer is formed in either one of the rear surface of the lance housing and the front surface of the retainer, whereas at least one guiding rib engageable with the respective guiding groove is provided on the other.

6. The connector of claim 1, wherein the housing main body is formed with an accommodation recess capable of at least partly accommodating the retainer.

7. A connector, comprising:

a housing main body including one or more cavities, into which one or more respective terminal fittings are at least partly insertable, the housing main body further including an accommodation recess, a lance housing to be located at a front side of the housing main body and including one or more terminal accommodation holes, which will communicate with the respective cavities, and one or more locking lances resiliently deformably projecting at the terminal accommodation holes to primarily lock the terminal fittings at least partly accommodated in the terminal accommodation holes, and a retainer to be located behind the lance housing and at least partly accommodated in the accommodation recess, the retainer being movable to a first position for permitting the insertion of the terminal fittings into the terminal accommodation holes and to a second position for secondarily locking the terminal fittings, wherein the rear surface of the lance housing and the front surface of the retainer are arranged in contact with each other, wherein at least one guiding groove extending substantially in a moving direction of the retainer, and is formed in either one of the back surface of the accommodation recess and the rear surface of the retainer, whereas at least one guiding rib engageable with the respective guiding groove is provided on the other.

8. The connector of claim 1, wherein a front holder is to be arranged on the front surface of the lance housing for at least partly covering the locking lances.

* * * * *